US005123159A

United States Patent [19]

Kubo et al.

[11] Patent Number: 5,123,159

[45] Date of Patent: Jun. 23, 1992

[54] HAIR CLIPPER

[75] Inventors: Nobuhiro Kubo, Hikone; Shoji Fujikawa, Ishibe; Seiko Chikano, Hikone, all of Japan

[73] Assignee: Matsushita Electric Works, Ltd., Osaka, Japan

[21] Appl. No.: 565,501

[22] Filed: Aug. 10, 1990

[30] Foreign Application Priority Data

Aug. 28, 1989 [JP] Japan ..... 1-220576
Jan. 26, 1990 [JP] Japan ..... 2-17172

[51] Int. Cl.[5] ..... B26B 19/04
[52] U.S. Cl. ..... 30/196; 30/200
[58] Field of Search ..... 30/195, 196, 197, 198, 30/199, 200, 201

[56] References Cited

U.S. PATENT DOCUMENTS

| | | | |
|---|---|---|---|
| 1,713,369 | 5/1929 | Borrmann | 30/201 |
| 3,387,367 | 6/1968 | Merzon | 30/201 |
| 4,152,830 | 5/1979 | Meijer et al. | 30/195 |
| 4,557,050 | 12/1985 | Haraguchi et al. | 30/195 |
| 4,614,036 | 9/1986 | Haraguchi | 30/200 |
| 4,776,095 | 10/1988 | Tsujimoto et al. | 30/201 |
| 4,825,546 | 5/1989 | Araki et al. | 30/201 |

FOREIGN PATENT DOCUMENTS

| | | | |
|---|---|---|---|
| 0147134 | 7/1985 | European Pat. Off. . | |
| 648078 | 7/1937 | Fed. Rep. of Germany | 30/196 |
| 0031351 | 3/1979 | Japan | 30/201 |
| 269434 | 4/1927 | United Kingdom . | |
| 781143 | 8/1957 | United Kingdom . | |
| 868332 | 5/1961 | United Kingdom . | |

*Primary Examiner*—Frank T. Yost
*Assistant Examiner*—John M. Husar
*Attorney, Agent, or Firm*—Stevens, Davis, Miller & Mosher

[57] ABSTRACT

A hair clipper has an elongated housing with a cutter head at its front and an elongated base cover connected thereto for movement between open and closed positions. The cutter head includes a stationary blade with a row of teeth and a movable blade with a like row of teeth which is driven to reciprocate relative to the stationary blade in hair shearing engagement therebetween. The teeth of the stationary and movable blades are cooperative to define a cutting edge. The base cover is formed at its front with a hair entrapping edge which extends substantially parallel with the cutting edge and which is kept spaced from the cutting edge in the open position and comes close to the cutting edge in the closed position. The hairs are introduced past the hair entrapping edge over the cutting edge in the open position, and subsequently seized between the hair entrapping edge and the cutting edge in the closed position for shearing at the cutting edge. An improvement resides in that the clipper includes an adjuster mechanism for adjusting the amount of the hairs to be cut in order to selectively perform the hair shearing at different modes, i.e., hair cutting mode and hair thinning modes.

16 Claims, 31 Drawing Sheets 62
60
12
11
10
74
50
79
77
30
16
31
32
33
43
45
44
41
42
82
14
82
85
80
110
111
112
13
86
87
118
115
117
90
100
88
20
89
109
107
106
104
26
102
105
24
23
108
100
10
22
12

HAIR CLIPPER

BACKGROUND OF THE INVENTION

1. Field of the Invention

The present invention is directed to a hair clipper, and more particularly to improvements on a hair clipper of a home use type having a cutter head and a base cover with a hair entrapping edge which is movable toward and away from a cutting edge of the cutter head.

2. Description of the Prior Art

Home hair shearing has been generally done by the use of a scissors. With the scissors, it is rather difficult for an unskilled person to perform hair shearing since it requires to manipulate the scissors in one hand and at the same time to hold hairs between the fingers of the other hand. Particularly, when manipulating the scissors, the blade edges of the scissors will engage the hairs at an inclined angle and be likely to push the hairs out of position along the blade edges as the blades are closed, failing to provide a straight cut. Thus, the straight cut with the use of the scissors requires a considerable skill and is found not to be practical in home. On the other hand, powered hair clippers have been utilized for many years in homes which are easy to manipulate and effect a straight cut. The prior hair clipper, as typically shown in U.S. Pat. No. 4,825,546, is provided with a cutting head having a toothed stationary blade and a toothed movable blade. The movable blade is driven to reciprocate in hair shearing engagement between the toothed edges of the stationary and movable blades. Although the prior hair clipper may have a comb projecting past the cutting edge of the cutter head, it is manipulated to move in advance of the cutting edge which are held in contact or in close relation with the skin. Therefore, the prior art hair clipper is still required to be carefully manipulated in such a manner not to injure the skin by the cutting edge. This is particularly important when shearing the hairs of a baby or child. To eliminate the above problems and insufficiencies, a novel and unique hair clipper has been proposed in our copending application Ser. No. 446,124 filed on Dec. 5, 1989 now U.S. Pat. No. 5,050,034 in which an elongated base cover is hinged to a like elongated housing formed at its front end with a cutting head having toothed stationary and movable blades. However, the proposed hair clipper is not capable of selecting between hair shearing modes of different shearing capabilities and therefore fails to adequately meet convenience requirements of changing the hair shearing modes depending upon differing portions of the head. In this respect, the prior clippers are found to be still unsatisfactory for safe and convenient hair styling.

SUMMARY OF THE INVENTION

The above problem has been eliminated by the present invention which provides an improved hair clipper for home use which can be safely and easily manipulated by an unskilled person, yet assuring different hair shearing modes selectively for different portions of the hairs. The hair clipper in accordance with the present invention comprises an elongated housing with a cutter head at its front end and an elongated base cover connected thereto for movement between open and closed positions. The cutter head includes a stationary blade with a row of teeth and a movable blade with a like row of teeth which is driven to reciprocate relative to the stationary blade in hair shearing engagement therebetween. The teeth of the stationary and movable blades are cooperative to define a cutting edge. The base cover is formed at its front with a hair entrapping edge which extends in substantially parallel with the cutting edge and which is kept spaced from the cutting edge in the open position and comes close to the cutting edge in the closed position. The hair entrapping edge allows hairs to be introduced past the cutting edge in the open position and seize the hairs between the cutting edge and the hair entrapping edge in the closed position for shearing the hairs at the cutting edge. In the closed position, the hair entrapping edge is located forwardly of the cutting edge so as to keep the cutting edge spaced from the skin of the user. Thus, the hair shearing can be made by guiding the hair entrapping edge across the skin of the head to collect the hairs between the member and the cutting edge and subsequently to shear thus collected hairs by the cutting edge. In this manner, the hair shearing can be effected by repeating to move the hair entrapping member from the open position to the closed position while guiding only the hair entrapping member in closely adjacent relation with the skin and maintaining the cutting edge spaced away from the skin, eliminating the possibility of injuring the skin by the cutting edge during the hair shearing operation. An improvement resides in that the clipper includes adjust means for adjusting the amount of the hair to be cut at the cutting edge.

Accordingly, it is a primary object of the present invention to provide an improved hair clipper which is capable of effecting hair shearing selectively in different shearing modes for convenient and versatile cutting, yet assuring easy and safe hair shearing.

The adjust means is provided for selection between a first cutting condition in which substantially the entire teeth of the stationary and movable blades are in hair shearing engagement and a second cutting condition in which only particular regions of the stationary and movable blades are in effective hair shearing engagement.

In a preferred embodiment, the adjust means comprises a hair thinning plate with a comb-like edge at its front end. The hair thinning plate is slidable along the length of the housing to be movable between the first cutting condition where the comb-like edge is spaced away from the cutting edge to permit the entire teeth of the stationary and movable blades to be in effective hair shearing engagement and the second cutting condition where the comb-like edge extends over the cutting edge to permit only the particular regions of the teeth of the stationary and movable blades to be in effective hair shearing engagement.

It is therefore another object of the present invention to provide an improved hair clipper in which a hair thinning plate is cooperative with the cutting edge to effect the hair shearing selectively by making the use of substantially the entire teeth of the blades and by the use of particular regions of the teeth.

Alternatively, a like hair thinning plate with a comb-like edge may be slidable on the cutting head along the edgewise direction thereof or slidable on the bottom of the base cover along the lengthwise direction thereof so as to be movable between the first cutting condition and the second cutting positions of the like hair shearing capabilities.

Further, in order to vary the amount of the hair cut at the cutting edge, the movable blade is rendered movable relative to the stationary blade in a direction of varying the distance between the forward edges of the two blades. The stationary blade is specially formed in its forward edge with a row of teeth composed of first teeth of small depth and second teeth of larger depth such that the first teeth are divided into plural groups alternated by the second teeth. When the movable blade is shifted to have its teeth close to the forward edge of the stationary blade, substantially entire depth of each of the first teeth and the corresponding depth of the second teeth of the stationary blade are in effective hair shearing engagement with those of the movable blade so that the hair shearing is made at substantially the entire length the cutting edge. When, on the other hand, the movable blade is shifted in the opposite direction, the stationary blade comes in effective hair shearing engagement with the movable blade only at the bottom portion of each of the second teeth, thus reducing the amount of the hairs to be sheared at the cutting edge.

It is therefore a still further object of the present invention to provide an improved hair clipper in which the movable blade is shiftable relative to the stationary blade in an edgewise direction to vary the amount of the hairs to be cut at the cutting edge.

The comb-like edge of the hair thinning plate as well as the hair entrapping edge are preferably formed to have a number of comb-teeth arranged in parallel with the cutting edge for smoothing the hairs to the cutting edge, which is therefore a further object of the present invention.

In another embodiment of the present invention, the base cover is formed at a portion immediately rearwardly of the hair entrapping edge with a slot extending in parallel with the hair entrapping edge. The base cover is allowed to move past the closed position towards the housing into a position where the cutting edge extends through the slot to expose only the forwardmost portion of the cutting edge while concealing the remaining portion thereof within the slot, thus limiting the amount of the hairs to be cut at the cutting edge projecting outwardly of the base cover. In this position which is effected by gripping the base cover most closely to the housing, the hair clipper is manipulated in such a manner as to guide the hairs entrapped at the hair entrapping edge along the outer bottom of the base cover to the tip of the cutting edge exposed on the outer bottom of the base cover for a reduced hair shearing capability, i.e., hair trimming purpose.

It is therefore a further object of the present invention to provide an improved hair clipper which is capable of effecting the hair shearing selectively by utilization of the entire cutting edge and by utilization of only the tip portion of the cutting edge.

In addition to the slot, the base cover may be provided with a shutter for closing the slot when the above hair trimming is not intended in order to prevent unintended projection of the cutting edge onto the outer bottom of the base cover. The shutter may be additionally formed with a row of grooves through which particular portions of the cutting edge are allowed to expose for further limited hair shearing only at thus exposed particular portion of the cutting edge.

The base cover is preferred to be detachably connected to the housing and is held thereto by means of a retainer spring such that the base cover is allowed to move between the open and closed positions as being supported thereto. The retainer spring is configured to detach the base cover from the housing when the base cover is forced to open further beyond the open position. Thus, the base cover can be easily detached from the housing simply by manipulating the base cover to open to a further extent, which is therefore a further object of the present invention.

These and still other object and advantageous features of the present invention will become more apparent from the following description of the embodiments of the present invention when taken in conjunction with the attached drawings.

DETAILED DESCRIPTION OF THE PREFERRED EMBODIMENTS

First Embodiment <FIGS. 1 to 24>

Figure 1:
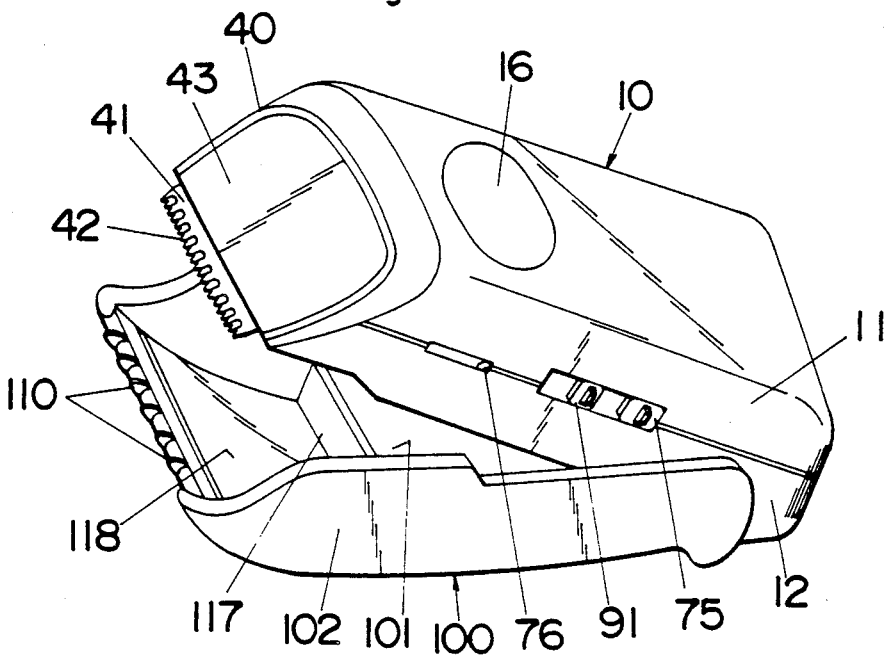
FIG. 1 is a perspective view of a hair clipper in accordance with a first embodiment of the present invention.
Figures 4, 5:
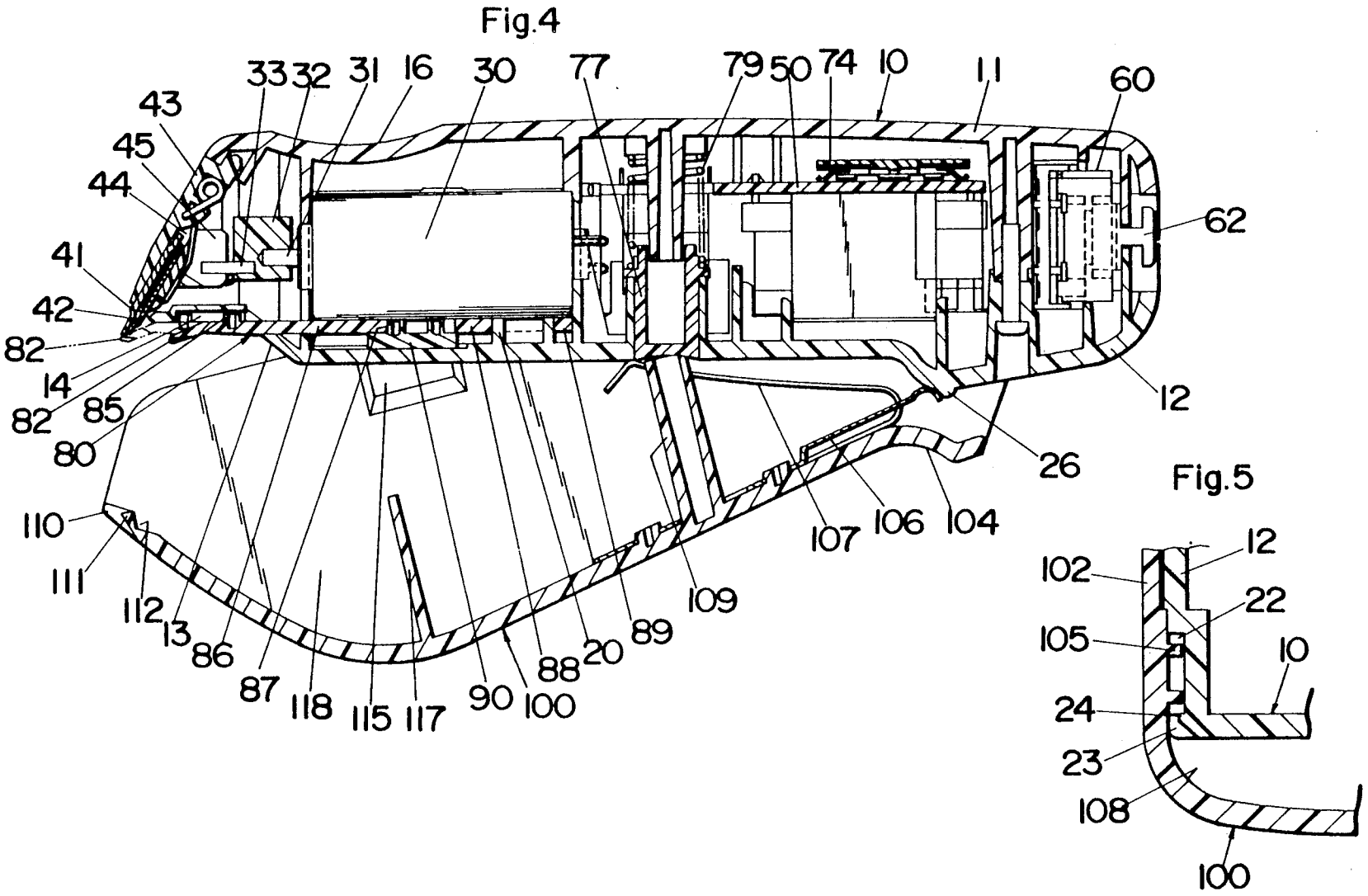
FIG. 4 is a side sectional view of the hair clipper.
FIG. 5 is a sectional view taken along line 5—5 of FIG. 2.

Referring now to FIG. 1, there is shown a hand-held clipper in accordance with a first embodiment of the present invention. The hair clipper comprises an elongated housing 10 and an elongated base cover 100 which are hinged at their rear ends to be movable between an open position [FIGS. 1 and 2] and a closed position [FIGS. 12 and 13], in a like manner as a conventional stapler. As seen in the figures, the housing 10 has its longitudinal axis crossed with a longitudinal axis of the base cover 100 at an angle of about 15° in the open position, and has the axis generally in parallel relation with the latter axis in the closed position. The housing 10 is provided at its front end with a cutter head 40 which comprises a stationary blade 41 with a toothed edge and a movable blade 42 with a like toothed edge. As shown in FIG. 4, the stationary blade 41 is supported on an interior surface of a head plate 43 fitted in the front end of the housing 10. The movable blade 42 is supported at its one end by a carrier 44 which is held slidable on the interior surface of the head plate 43 such that the toothed edge of the movable blade 42 comes into hair shearing engagement with the corresponding toothed edge of the stationary blade 41 with the leading edge of the movable blade 41 offset upwardly or retarded from the leading edge of the stationary blade 41 by a slight extent. The stationary blade 41 and the movable blade 42 define therebetween a cutting plane which is inclined by an angle of 60° to 90° with respect to the longitudinal axis of the housing 10.

The cutter head 40 thus formed is held in position by a pair of clips 47 each of which has its ends hooked to the head plate 43 and the interior of the housing 10. Disposed in the middle of the housing 10 is an electric rotary motor 30 which has an output shaft 31 coupled to a joint 32 with an eccentric shaft 33. The eccentric shaft 33 engages into a cam socket 45 formed on the carrier 44 in order to translate the rotational movement of the output shaft 31 into a reciprocating movement of the movable blade 42 relative to the stationary blade 41. The motor 30 is powered by a rechargeable battery 51 which is mounted on a printed board 50 and is recharged from the conventional AC voltage source through a charger circuit formed on the board 50. The charger circuit is connected to a plug unit 60 with a pair of prongs 61 for insertion into a conventional AC voltage receptacle and a button 62 exposed onto the rear end of the housing 10 to be accessible by the user. The plug unit 60 is slidably connected to the housing 10 so that the prongs 61 can eject from within the housing 10 for connection to the AC voltage source when the recharging is required.

Figure 6:
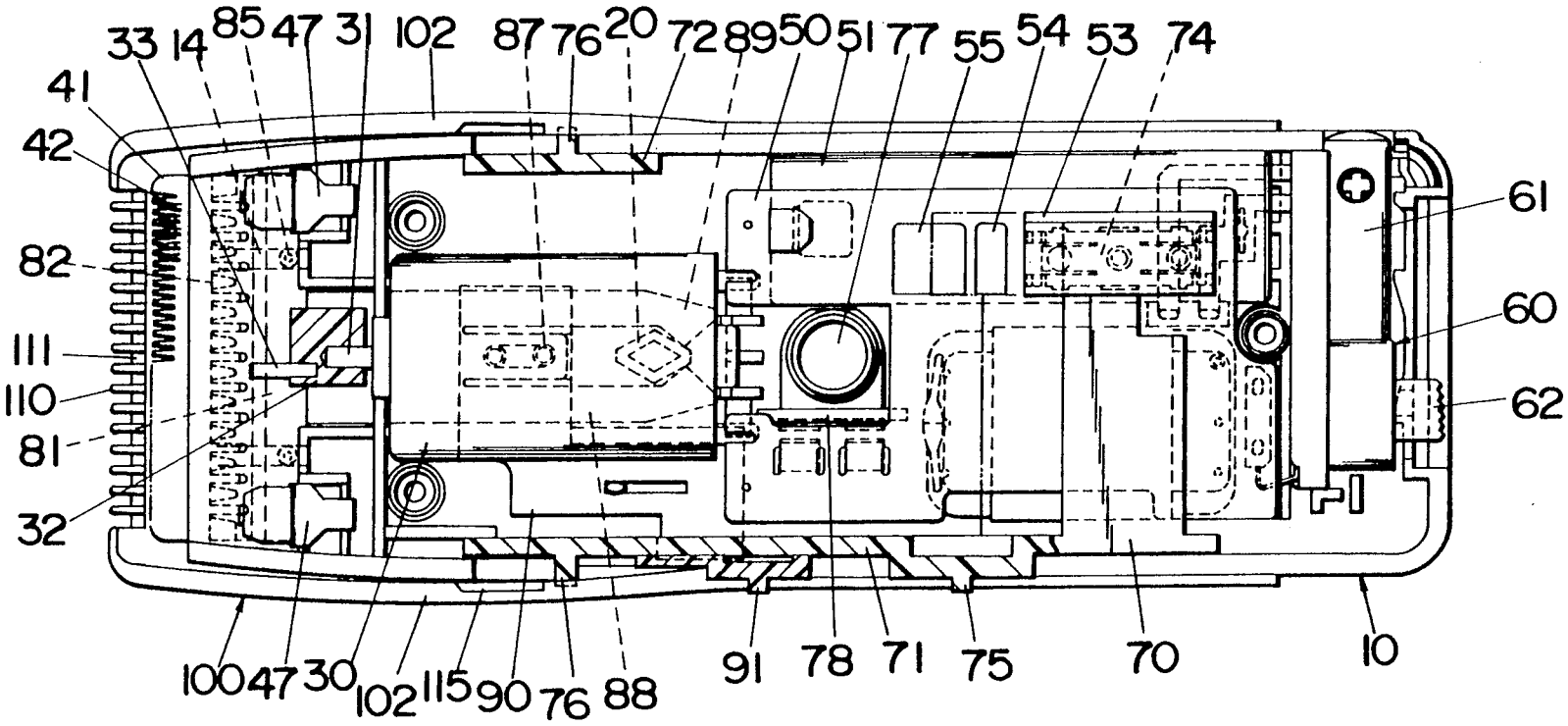
FIG. 6 is a horizontal section of the hair clipper.

The housing 10 comprises upper and lower halves 11 and 12 between which a slider frame 70 is received for movement along the lengthwise direction of the housing 10 between an OFF-position, a conditional ON-position, and a constant ON-position. As shown in FIG. 6, the slider frame 70 has a pair of long and short side bars 71 and 72 integrally connected by a bridge segment (not shown) and is held slidable with the individual bars 71 and 72 fitted in corresponding grooves formed in the mating surfaces between the upper and lower halves 11 and 12. The longer side bar 71 is provided at its rear end with a contactor 74 which is cooperative with first, second, and third contacts 53 to 55 to connect and disconnect the motor 30 to and from the battery 51. A switch handle 75 formed on the same side bar 71 projects on the side of the housing 10 to be accessible by a thumb of the user's hand holding the clipper.

Also included in the housing 10 is a hair thinning plate 80 which is slidable along the lengthwise direction of the housing 10 and connected at its rear end 87 to a slide plate 90 also slidably received in the housing 10.

Figure 8:
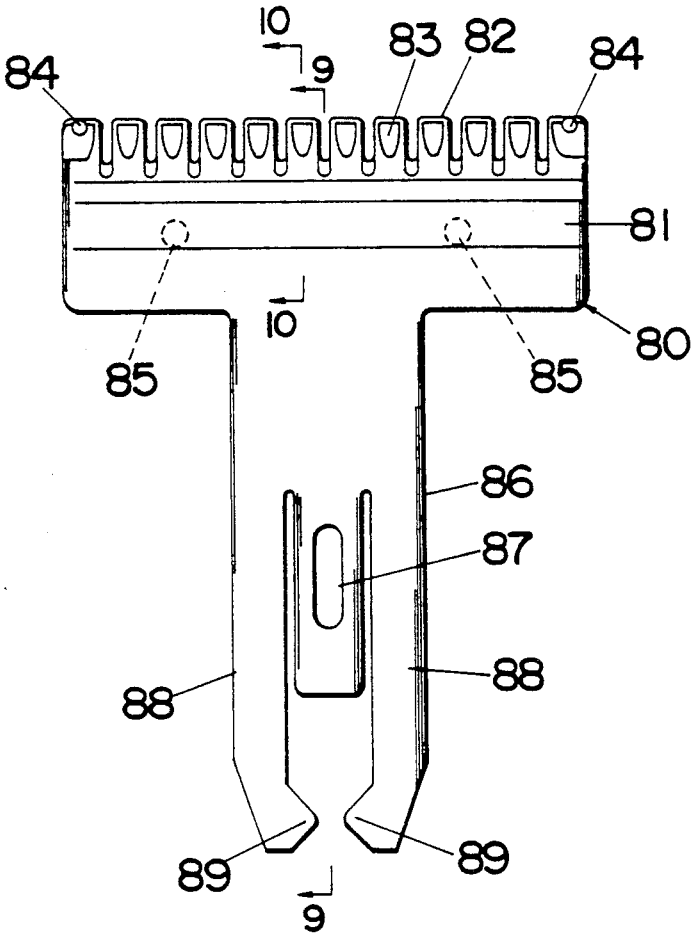
FIG. 8 is a bottom view of a hair thinning plate attached to the housing of the hair clipper.
Figure 9:
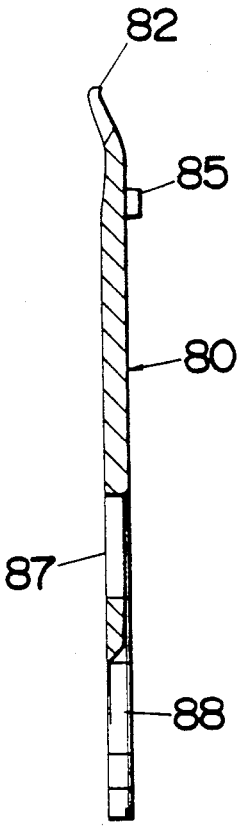
FIG. 9 is a sectional view taken along line 9—9 of FIG. 8.

As shown in FIG. 6, the slide plate 90 is formed at its one end with a knob 91 which projects on the side of the housing 10 forwardly of the switch handle 75 in axially aligned relation thereto so that it is also manipulated by the thumb of the user's hand holding the clipper to advance and retract the hair thinning plate 80 between a projected position [indicated by dotted lines in FIG. 4] and a retracted position [indicated by solid lines in FIG. 4]. As shown in FIG. 8, the hair thinning plate 80 is of generally T-shaped configuration with a horizontal section 81 with a row of comb-teeth 82 spaced evenly along the width dimension thereof and a vertical section 86 having the end 87 connected to the slide plate 90. The hair thinning plate 80 is assembled to the lower half 12 of the housing 10 with the vertical section 87 extending through an inclined wall 13 at the front bottom of the housing 10 and with a pair of studs 85 on the bottom of the horizontal section 81 slidably engaged with corresponding grooves 14 formed in the bottom of the housing 10 forwardly of the inclined wall 13, as shown in FIGS. 4 and 6. Integrally extending from the vertical section 86 is a pair of bifurcated resilient legs 88 each having a cam latch 89 at its free end. The cam latches 89 are engageable with a diamond catch 20 which, as shown by a dotted line in FIG. 6, projects on the interior of the lower half 12 of the housing 10 to define on its exterior a pair of longitudinally spaced dents. During the slide movement of the hair thinning plate 80, the resilient arms 88 flex outwardly in such a manner that the cam latch 89 can ride over the curved periphery of the catch 20 and is clicked into one of the dents. Whereby the hair thinning plate 80 is movable clickwise between the two projected and retracted positions.

Figure 10:
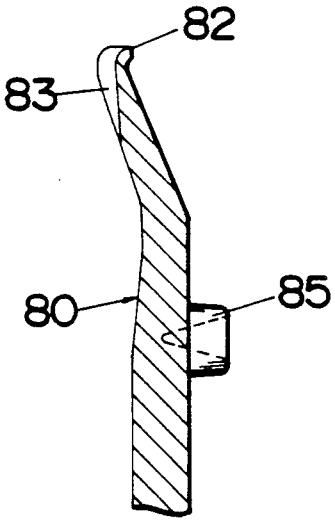
FIG. 10 is a sectional view taken along line 10—10 of FIG. 8.
Figure 11:
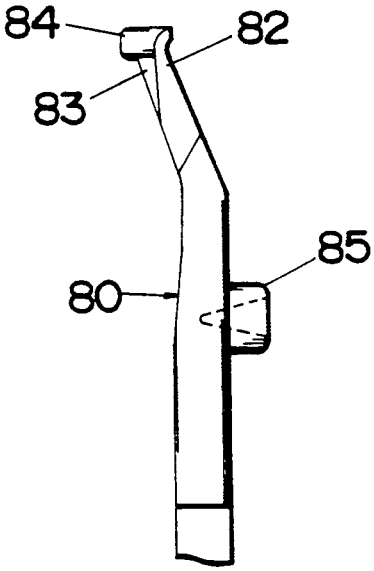
FIG. 11 is a side view of the hair thinning plate.
Figure 23:
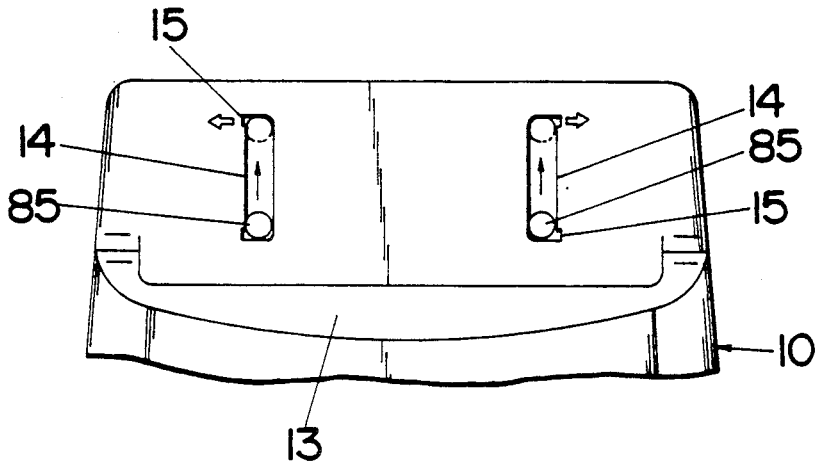
FIGS. 23 and 24 are partial views illustrating the sliding connection of the base cover to the front bottom of the housing in the retarded and advanced positions respectively.
Figure 24:
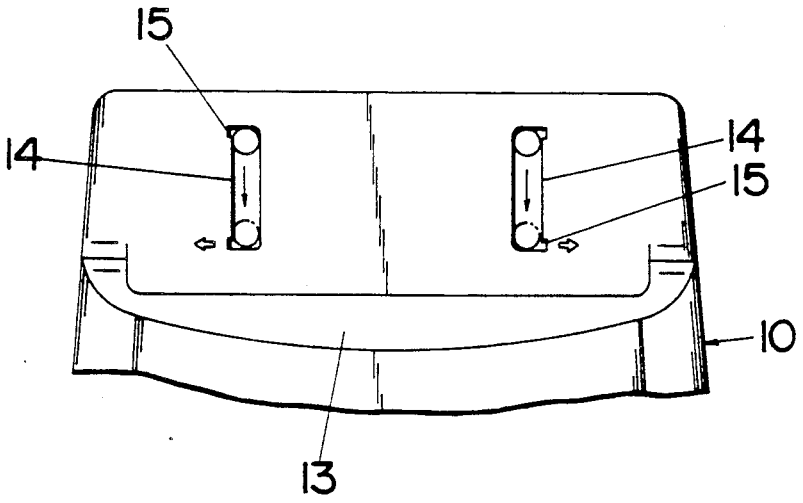

In the retracted position, the horizontal section 81 of the hair thinning plate 80 is concealed below the front end of the housing 10 rearwardly of the cutting edge for effecting the hair shearing at the cutting edge without the use of the comb-teeth 82. When the hair thinning plate 80 advances to the projected position, as indicated by dotted lines in FIG. 4, the comb-teeth 82 act to conceal particular portions of the cutting edge, thus disabling those portions spaced along the length of the cutting edge to limit the amount of the hairs to be cut, i.e., to effect a hair thinning. It is noted in this connection that a plane of the comb-teeth 82 is inclined with respect to the front bottom of the housing 10 in such a manner as to provide therebetween a clearance which is greater towards the rear edge of the comb-teeth 82 than at the front edge. This facilitates the escape of the hairs once pinched between the comb-teeth 82 and the housing 10, therefore preventing such hairs from being forcibly pulled during the manipulation of moving the clipper across the head. As shown in FIGS. 8, 10 and 11, the comb-teeth 82 are each configured to have a rounded recess 83 in its lower surface for facilitating to smoothly guide or comb the hairs as the clipper advances over the skin of the user. Further, as shown in FIGS. 23 and 24, each of the grooves 14 formed in the front bottom of the housing 10 for receiving the corresponding studs 85 of the hair thinning plate 80 is provided at its longitudinal ends with gutters 15 through which the clipped hairs entering the groove 14 can be forced away by the stud 85 as the hair thinning plate 80 moves from the retracted position to the projected position or vice versa.

Figure 7:
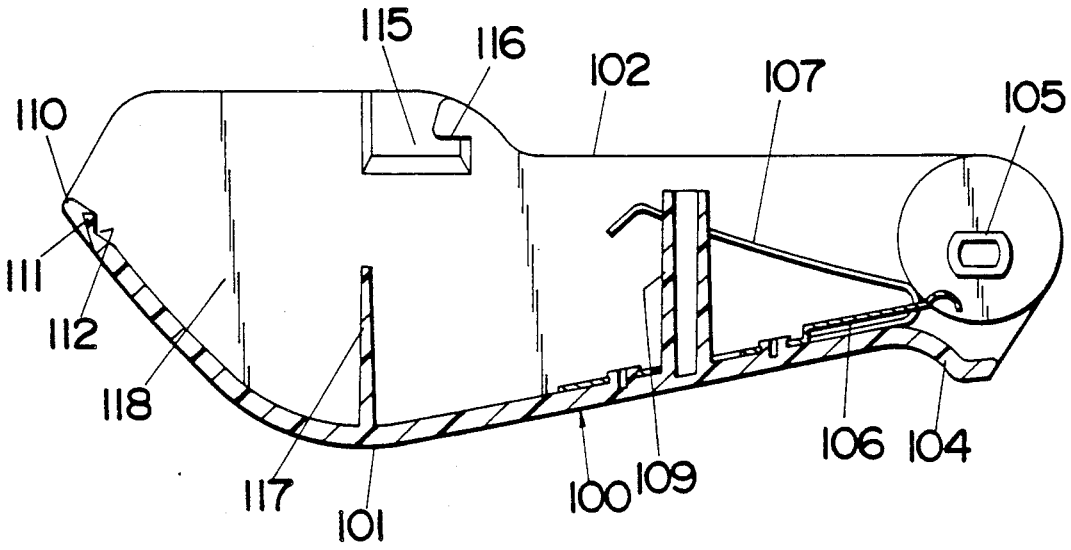
FIG. 7 is a sectional view of a base cover adapted to be hinged to a housing of the hair clipper.
Figure 12:
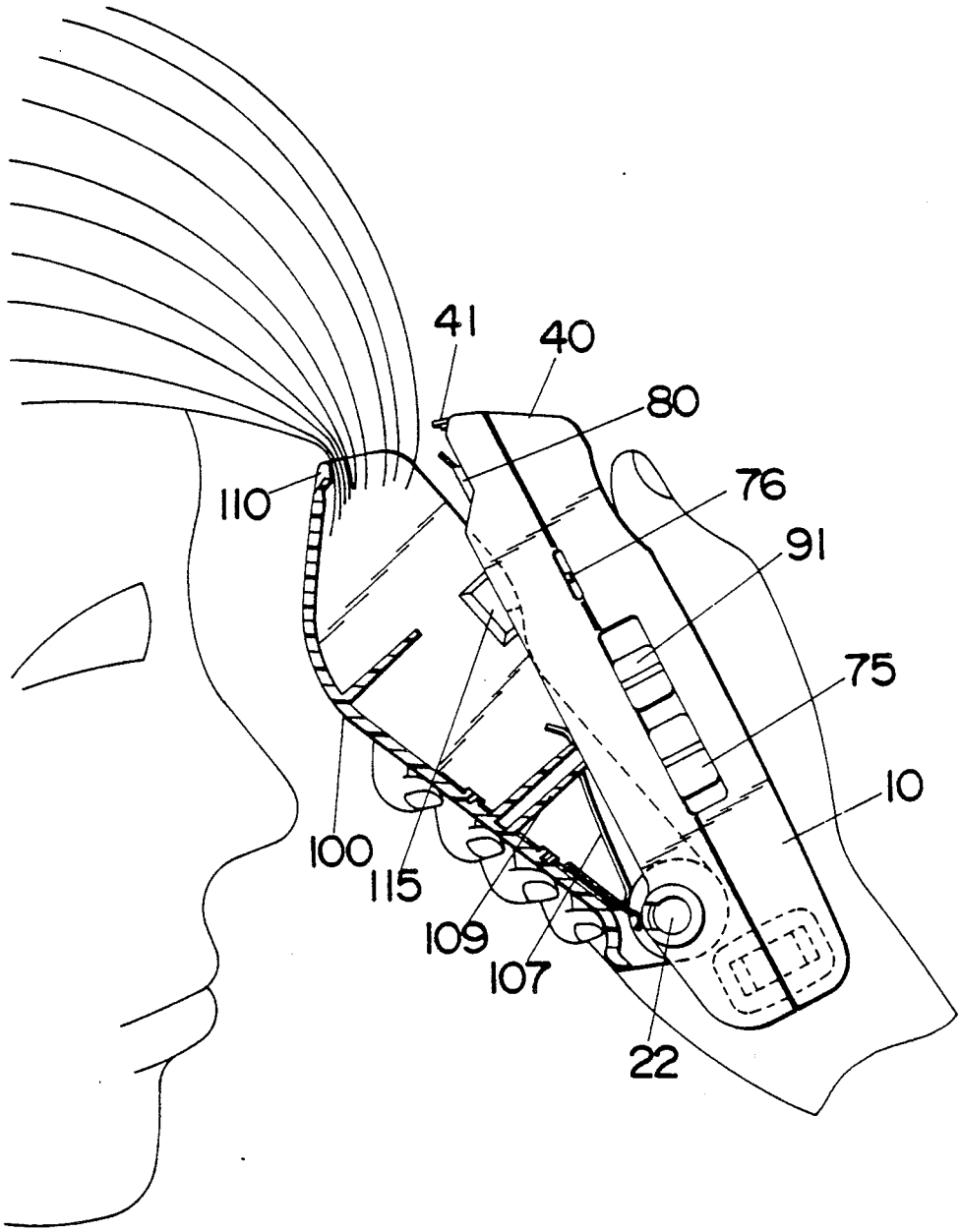
FIGS. 12 and 13 illustrate the hair clipper respectively in its open and closed conditions for shearing hairs.

The base cover 100 is of a generally U-shaped configuration having a bottom wall 101 and a pair of opposed side walls 102 extending upwardly from the lateral sides of the bottom wall 101 to define therebetween a space for receiving the bottom portion of the housing 10 in the closed position. Formed at the forward edge of the bottom wall 101 is a row of comb-teeth 110 arranged along the forward edge for smoothing the hairs prior to being cut at the cutting edge. As shown in FIGS. 6 and 7, the comb-teeth 110 project integrally from a forward edge 111 in a general plane of the front inclined bottom of the base cover 100. The forward edge 111 defines therebehind a recess 112 into which the cutting edge of the cutter head 40 projects when the base cover 100 is moved to the closed position, as shown in FIG. 14. It is this position that the hairs after being smoothed by the comb-teeth 110 are held between the comb-teeth 110 and the cutting edge to be sheared thereat. That is, as shown in FIG. 12, the hand clipper is firstly manipulated in its open position so as to smooth and guide the hairs between the comb-teeth 110 and the cutting edge and is then closed to the position of FIG. 13 to effect the hair shearing. In this manner, the hairs can be easily cut to straight without exposing the cutting edge directly to the skin, thereby assuring a safe hair shearing without the fear of accidentally injuring the skin by the cutting edge. The front outer wall of the base cover 100 is somewhat rounded or smoothly guiding the base cover 100 or the clipper across the skin, particularly the portions around the neck.

Figure 16:
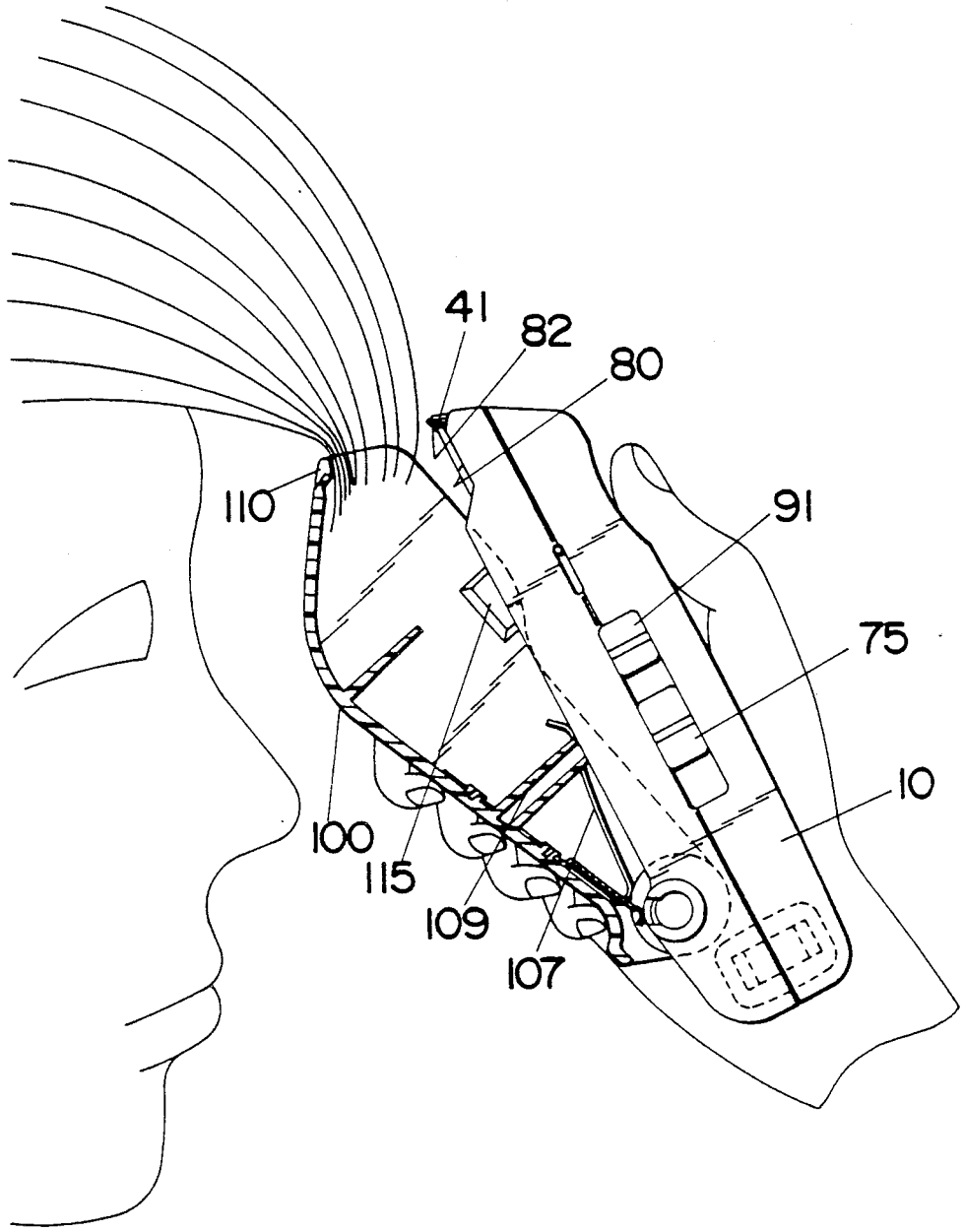
FIG. 16 illustrates the hair clipper in its open position with the hair thinning plate advanced for hair thinning operation.
Figure 17:
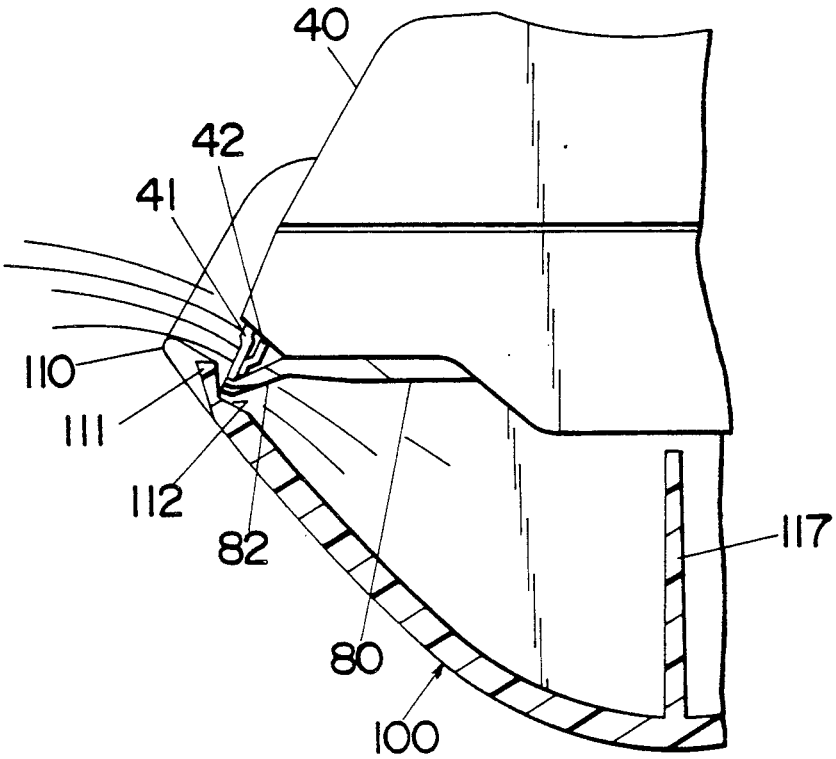
FIG. 17 is a partial view illustrating the hair shearing operation in the closed position with the hair thinning plate advanced to effect the hair thinning in cooperation with the cutting edge.
Figure 18:
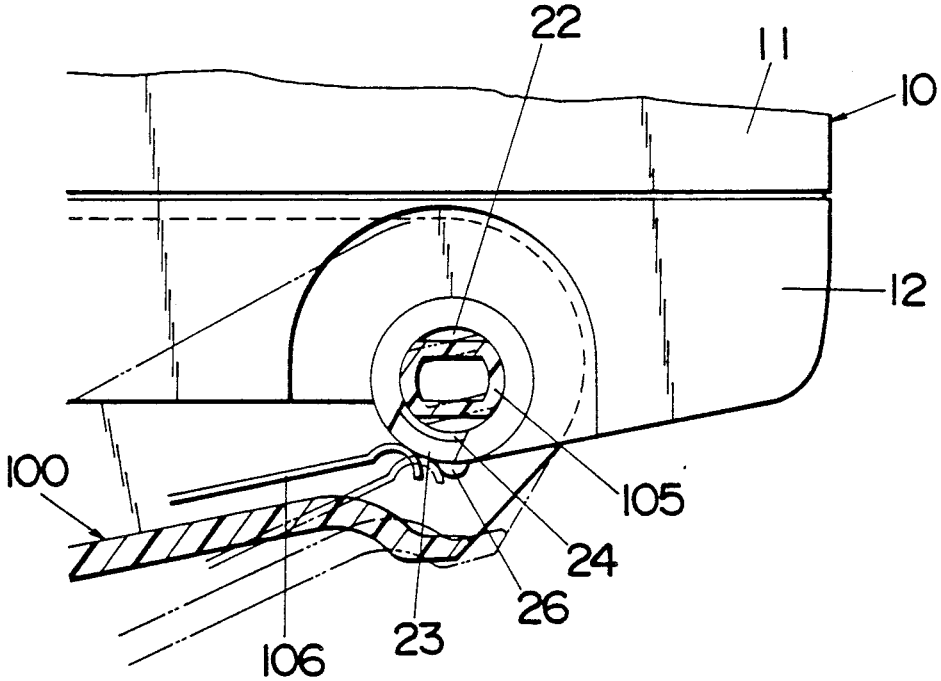
FIGS. 18 and 19 are respectively partial views illustrating a hinged connection between the housing and the base cover.

In the like manner, the hair thinning can be effected by repeating to open and close the clipper with the hair thinning plate 80 advanced to the projected position, as shown in FIGS. 16 and 17. In this mode, as described hereinbefore, the particular portions of the cutting edge is disabled by the comb-teeth 82 of the plate 80 to limit the amount of the hairs to be cut.

Figure 13:
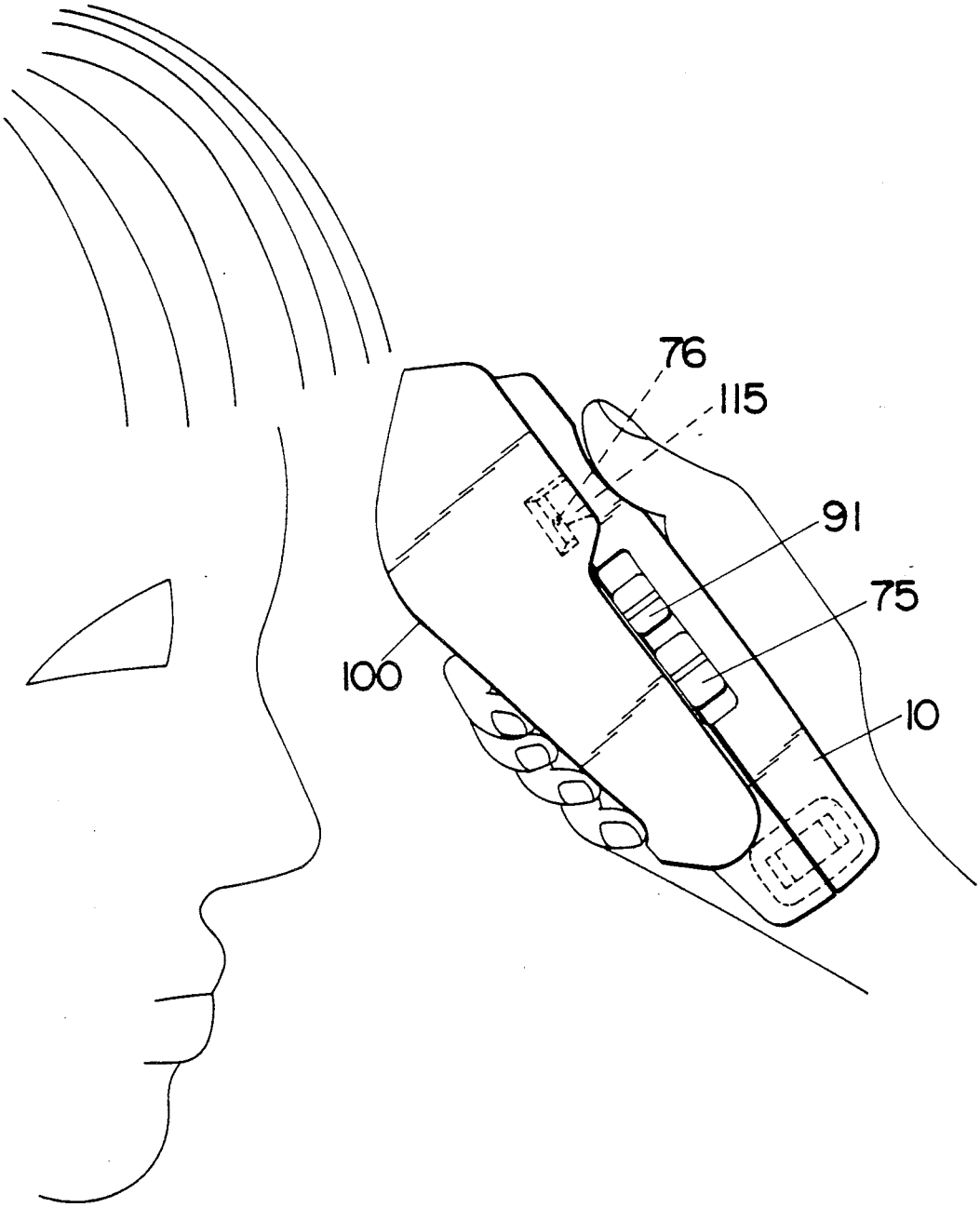
Figure 14:
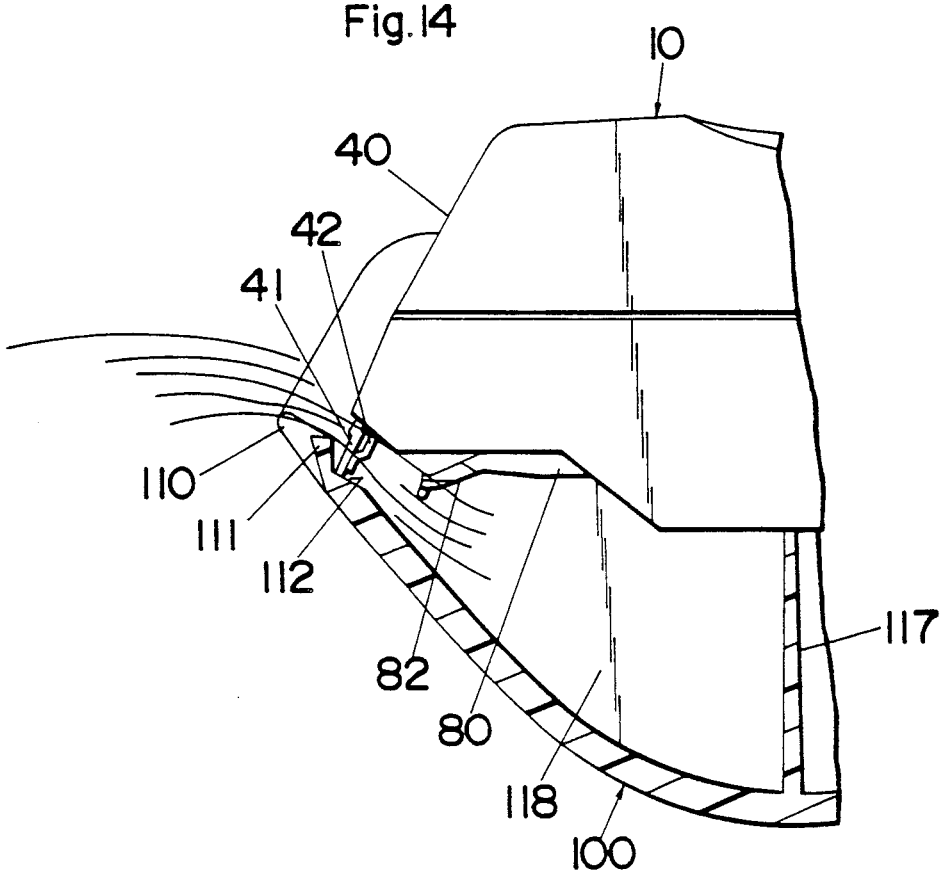
FIG. 14 is a partial view illustrating the hair shearing operation in the closed position with the hair thinning plate retarded from a cutting edge of the hair clipper.
Figure 15:
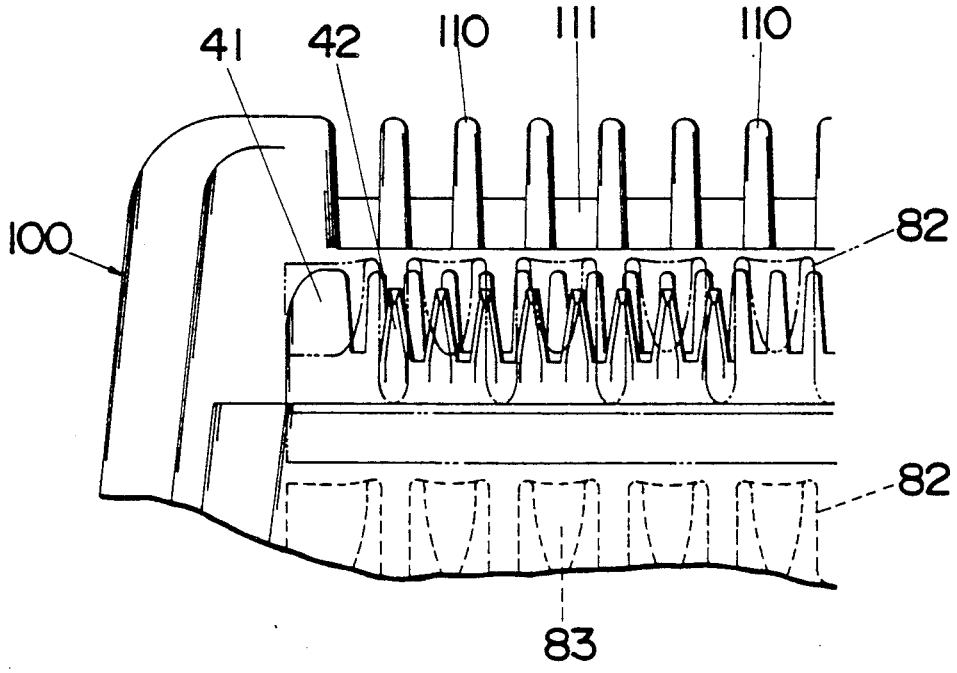
FIG. 15 is a partial view illustrating a relation between the cutting edge and a comb-teeth at the front of the hair thinning plate.

As shown in FIGS. 12 and 13, the hair clipper can be manipulated only by one hand of a user and the hair shearing an be made by repeatedly pressing the housing 10 toward the base cover 100. For secure holding of the hair clipper, the base cover 100 is formed on the rear end portion with a finger stop 104 while the housing 10 is formed in its top surface with a depression 16 for engagement with the thumb of the hand gripping the clipper. It is noted at this time that the clipper has two active switching modes for operation of the cutting edge. In a first switching mode which corresponds to the above conditional ON-position of the switch handle 75, the motor 30 is energized to drive the movable blade 42 only when the clipper is moved into the closed position and is deenergized each time the clipper is moved into the open position, the detail of which will be discussed later. In a second switching mode which corresponds to the constant ON-position of the switch handle 75, the motor 30 is constantly energized to drive the movable blade 42 irrespective of whether the clipper is in the open or closed position.

Figure 2:
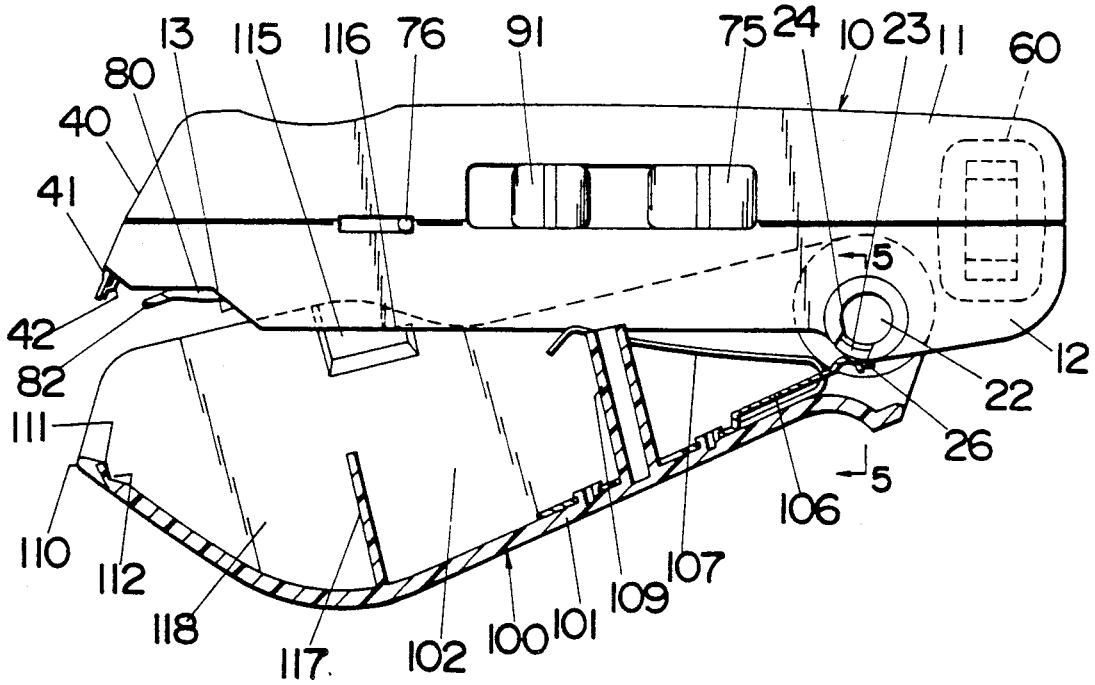
FIG. 2 is a side view, partly in section, of the hair clipper.
Figure 3:
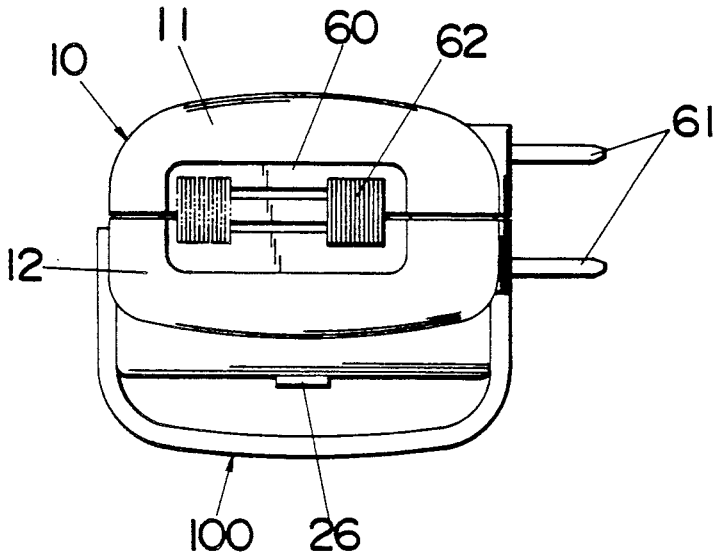
FIG. 3 is a rear view of the hair clipper.

For the hinged connection of the base cover 100 to the housing 10, the base cover 100 is formed at the rear end thereof with hinge bosses 105 each projecting integrally from each one of the opposed side walls 102 in a concentric relation. As shown in FIG. 7, each hinge boss 105 is in the form of a rounded projection defined by two parallel straight sides and opposed rounded ends lying in a common circular path. A corresponding pair of bearing holes 22 is formed in the opposed side walls at the rear end of the housing 10 to rotatively receive the hinge bosses 105. As shown in FIGS. 2 and 5, each bearing hole 22 has a notch 23 through which the corresponding boss 105 is permitted to come into the hole 22.

The notch 23 is oriented such that the base cover 100 is permitted to be attached and detached to and from the housing 10 only when the base cover 100 is opened or extended past the open position, thereby preventing the base cover 100 from being accidentally detached from the housing 10 during a normal shearing operation of moving the base cover 100 between the open and closed positions. In other words, the hinge boss 105 can be confined within the hole 22 during the movement of the base cover 100 between the open and closed positions, and is only permitted to escape through the notch 23 when the base cover 100 is opened to a further extent past the open position. Each notch 23 has on its bottom a rib 24 over which the hinge boss 105 snaps into and out of the corresponding bearing hole 22, preventing an accidental and unintentional removal of the base cover 100. The base cover 100 includes a leaf spring 106 which is secured at its end to the inner bottom of the base cover 100 to project rearwardly and upwardly therefrom for pressed contact with a cam projection 26 formed on the rear end bottom of the housing 10 to provide a spring force acting in the direction of retaining the base cover 100 to the housing 10 while the base cover 100 is angled with respect to the housing 10 between the open and closed positions. Another leaf spring 107 projects from the bottom of the base cover 100 to abut the bottom of the housing 10 forwardly of the cam projection 26 in order to bias the base cover 100 to the open position, thus giving a return force urging the base cover 100 to the open position each time it is moved to the closed position.

Figure 19:
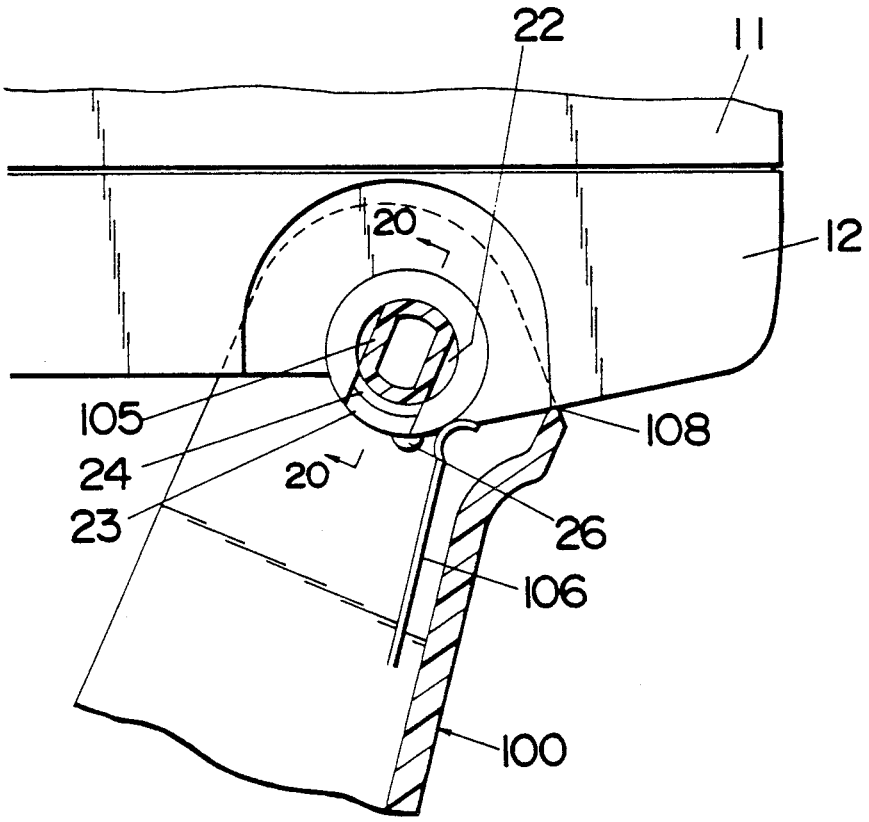
Figure 20:
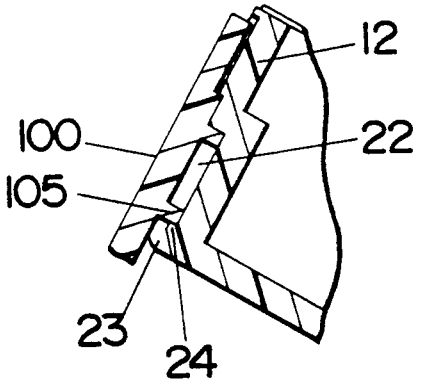
FIG. 20 is a sectional view taken along line 20—20 of FIG. 19.
Figure 21:
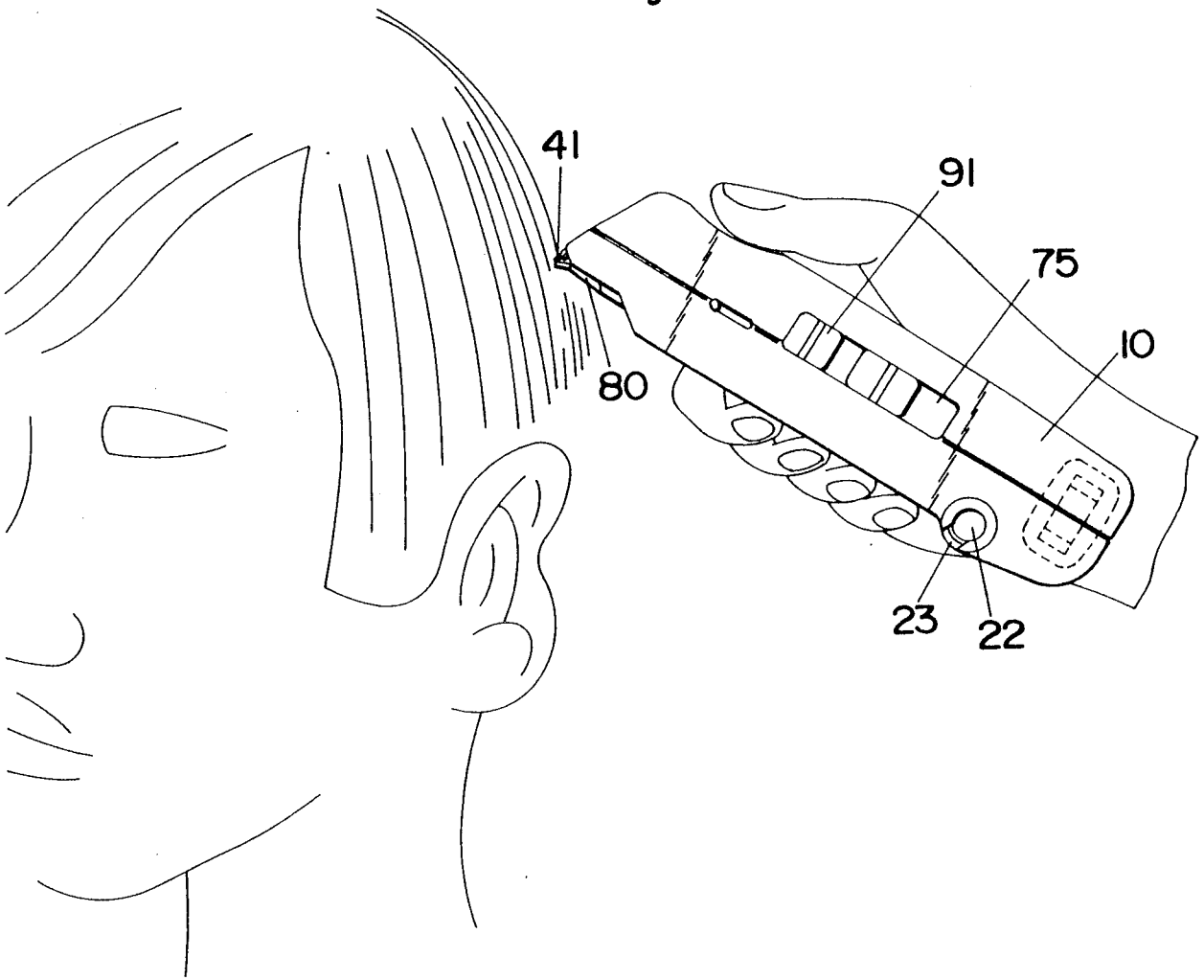
FIGS. 21 and 22 illustrates the hair clipper with the base cover detached for hair trimming operations with and without the use of the hair thinning plate, respectively.
Figure 22:
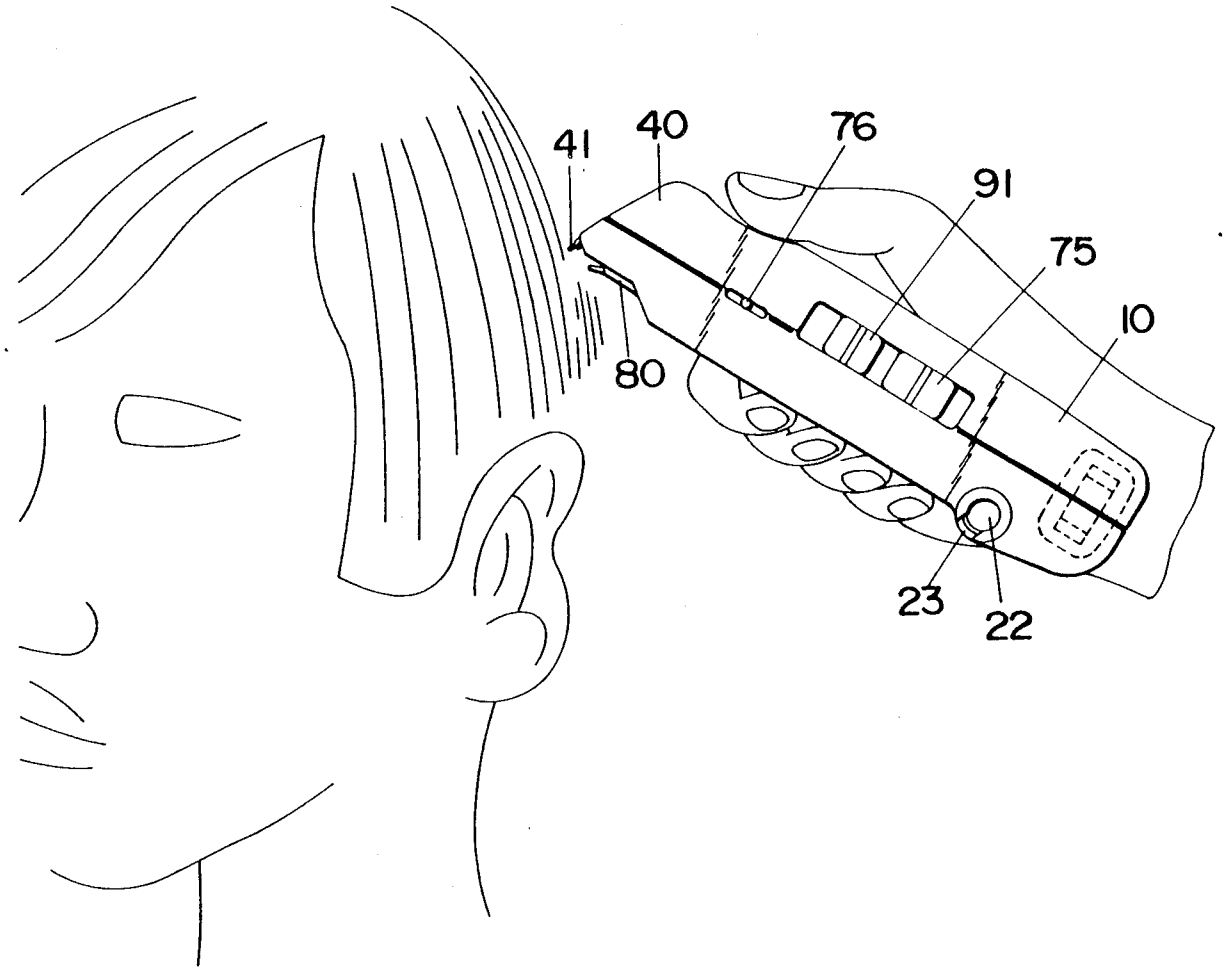

Detachment of the base cover 100 can be made simply by opening it to a further extent past the open position. At this occurrence, the free end of the leaf spring 106 will ride over the cam projection 26, as seen in FIG. 19, so that it will no longer give the force of retaining the base cover 100, allowing the hinge bosses 105 to escape out of the corresponding bearing holes 22 through the notches 23. It is noted at this time that, when forcing the base cover 100 to move past the open position, the side walls of the base cover 100 will be somewhat resiliently deformed outwardly, due to an interaction between rounded rear corner 108 at the juncture of the bottom and the side walls of the base cover 100 and the corresponding rounded corners extending across the bottom and sides of the housing 10, thereby facilitating the escape of the hinge bosses 105 from the bearing holes 22. FIGS. 21 and 22 illustrate other operational modes in which the base cover 100 is detached for trimming the hairs at the cutting edge with or without the use of the hair thinning plate 80.

Integrally projecting from the inner bottom center of the base cover 100 is an actuator pin 109 which abuts against a piston 77 vertically movable within the housing 10. The piston 77 carries a contactor 78 (only a portion of which is seen in FIG. 6) which opens and closes an auxiliary switch for energizing and deenergizing the motor 30 in response to the open and close movement of the base cover 100. That is, the contactor 78 closes the auxiliary switch to connect the battery 51 and the motor 30 when the switch handle 75 is in the conditional ON-position of conducting the first and second contacts 53 and 54 and at the same time the piston 77 is pushed upwardly by the actuator pin 109 in response to the closing movement of the base cover 100. When the switch handle 75 is in the constant ON-position of conducting the first and third contacts 53 and 55, the auxiliary switch is bypassed or the contactor 78 is inactive so that the motor 30 is energized independently of the position of the contactor 78. The piston 77 is urged downward by a coil spring 79 which also adds a spring force to bias the base cover 100 towards the open position.

At the OFF position of the switch handle 75, the housing 10 can be locked into the closed position by engagement of latch pins 76 projected on both sides of the housing 10 and grooves 115 formed respectively in the inner surface of the side walls 102 of the base cover 100, as shown in FIGS. 2 and 7. The latches pins 76 are formed on the side bars 71 and 72 of the slider frame 70 to be movable in the lengthwise direction of housing 10 together with the switch handle 75. As shown in FIG. 7, the groove 115 is of a generally L-shaped configuration with a vertical segment and a horizontal segment defining therebetween a shoulder 116 with which the latch pin 76 is to be engaged. A vertical section of the groove 115 is open to the upper edge of the side wall 102 so that the latch pin 76 at the conditional as well as constant ON-positions of the switch handle 75 can freely enter the groove 115 through the vertical section without being interfered with the shoulder 116 and that only the latch pin 76 at the OFF position can be engaged with the shoulder 116. The side walls 102 of the base cover 100 have enough resiliency such that they are capable of flexing outwardly to permit the latch pins 76 even at the OFF position of the switch handle 75 to ride over shoulder 116 into engagement therebehind, enabling the base cover 100 to be locked to the housing 10 even when the base cover 100 is closed with the switch handle 75 in the OFF-position. The latch pin 76 at the conditional or constant ON positions can be of course guided along the horizontal section into engagement with the shoulder 116 by sliding the switch handle 75 rearward while maintaining the housing 10 in the closed position, or moving the switch handle 75 back to the OFF-position after closing the base cover 100. The base cover 100 is additionally provided with a partition 117 which is located immediately rearwardly of the cutter head 40 in the closed position of the clipper so as to define a dust chamber 118 forwardly of the partition 117 for collecting the clipped hairs.

Turning back to FIGS. 8 and 11, the hair thinning plate 80 is provided at the lateral ends of the horizontal section 81 with bulges 84 which abut against the front end of the base cover 100 when the latter is in the closed position, thereby providing a slight clearance between the comb-teeth 82 of the plate 80 and the forward edge 111 of the base cover 100. With this clearance, the hairs can be well prevented from being entrapped between the hair thinning plate 80 and the base cover 100 during the manipulation of moving the clipper across the head of the skin with the hair thinning plate 80 kept in the projected position.

Second Embodiment <FIGS. 25 to 33>

Figure 25:
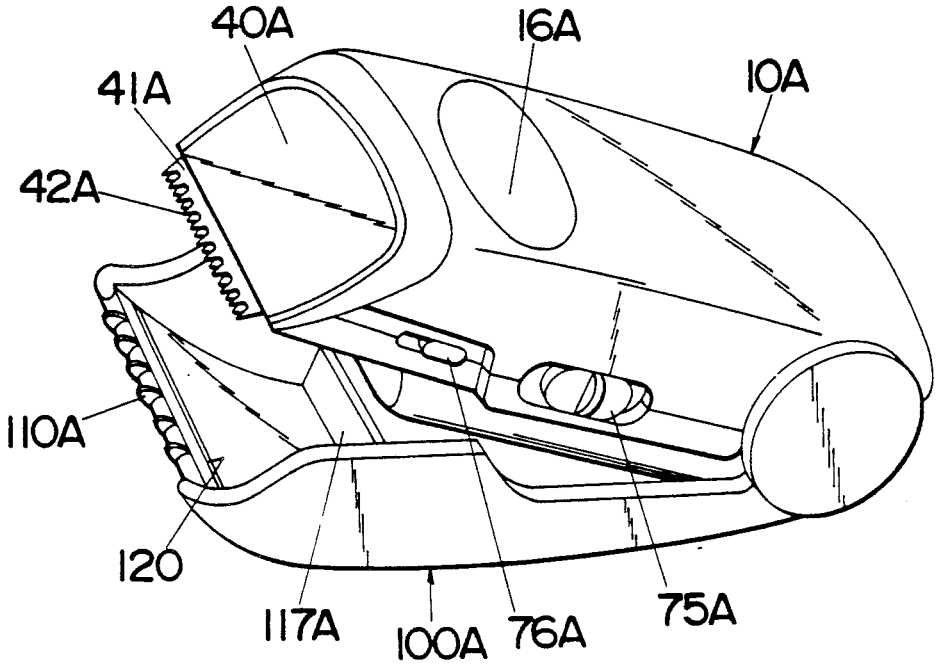
FIGS. 25 and 26 are perspective views of a hair clipper shown respectively in open and closed positions in accordance with a second embodiment of the present invention.
Figure 26:
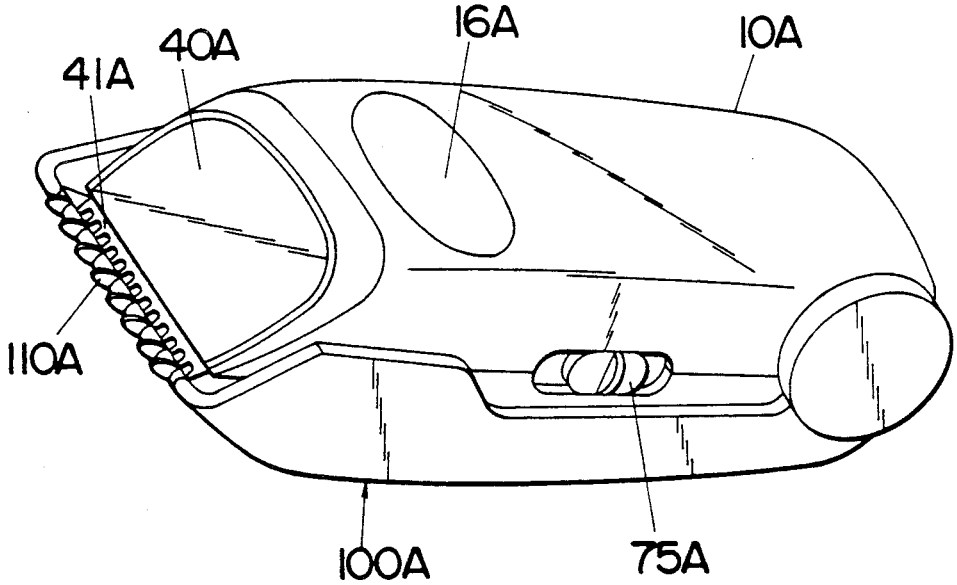
Figure 27:
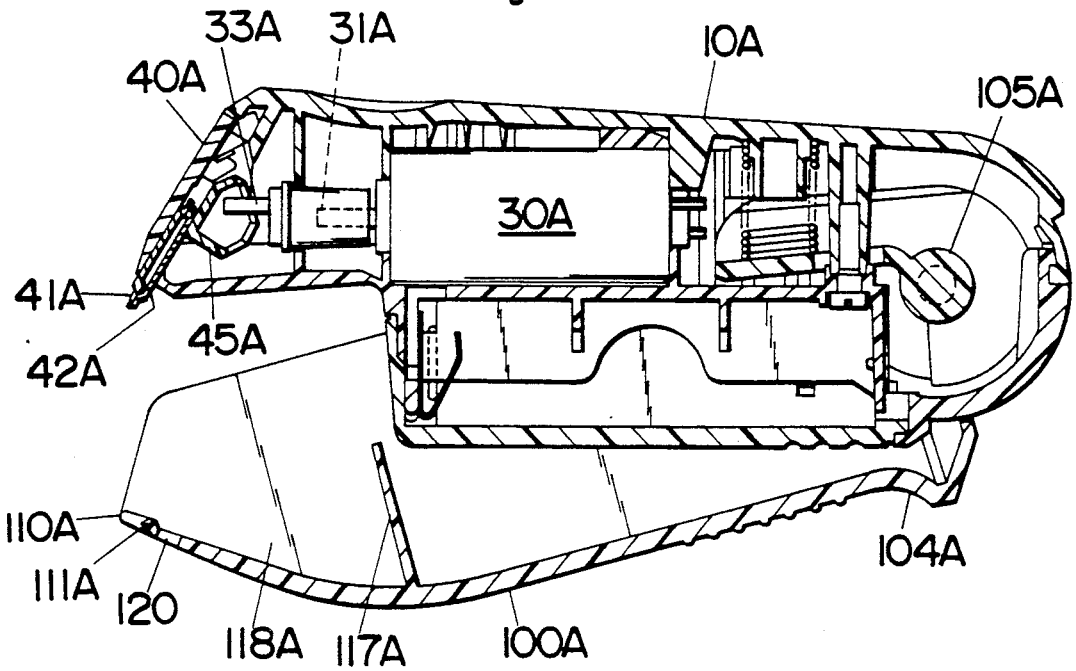
FIGS. 27 and 28 are sectional views of the hair clipper respectively in its open and closed positions.
Figure 28:
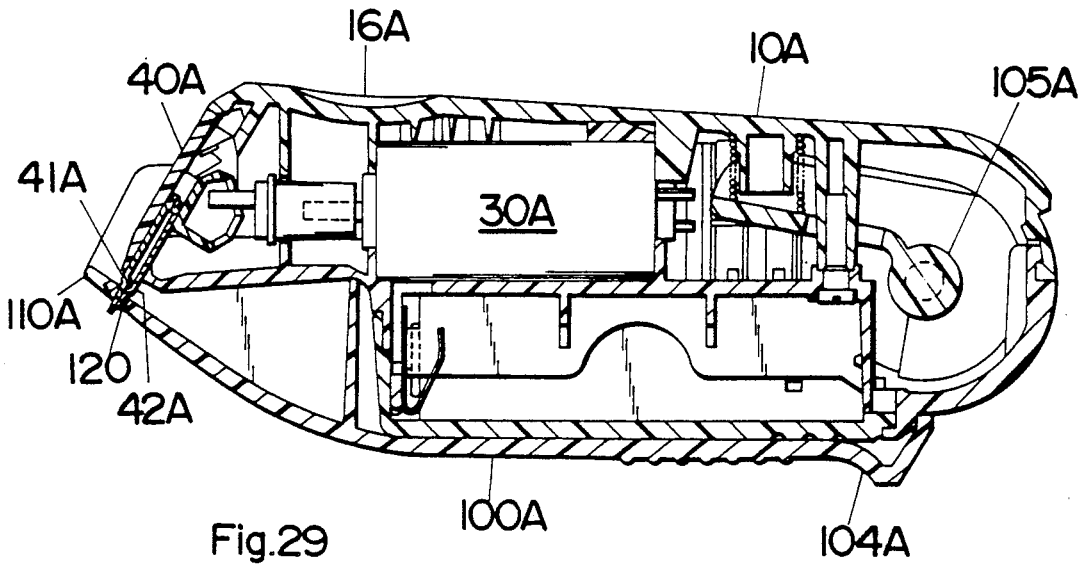
Figure 29:
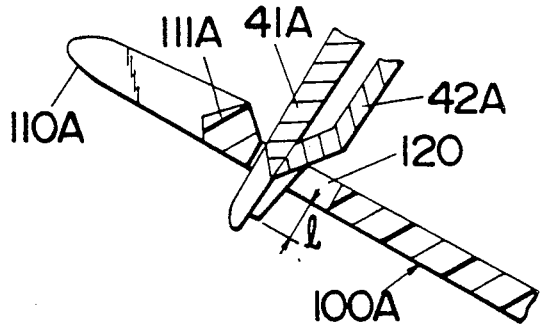
FIG. 29 is a partial view illustrating a cutting edge of the hair clipper in its closed position in relation to a slot formed in a base cover.
Figure 30A:
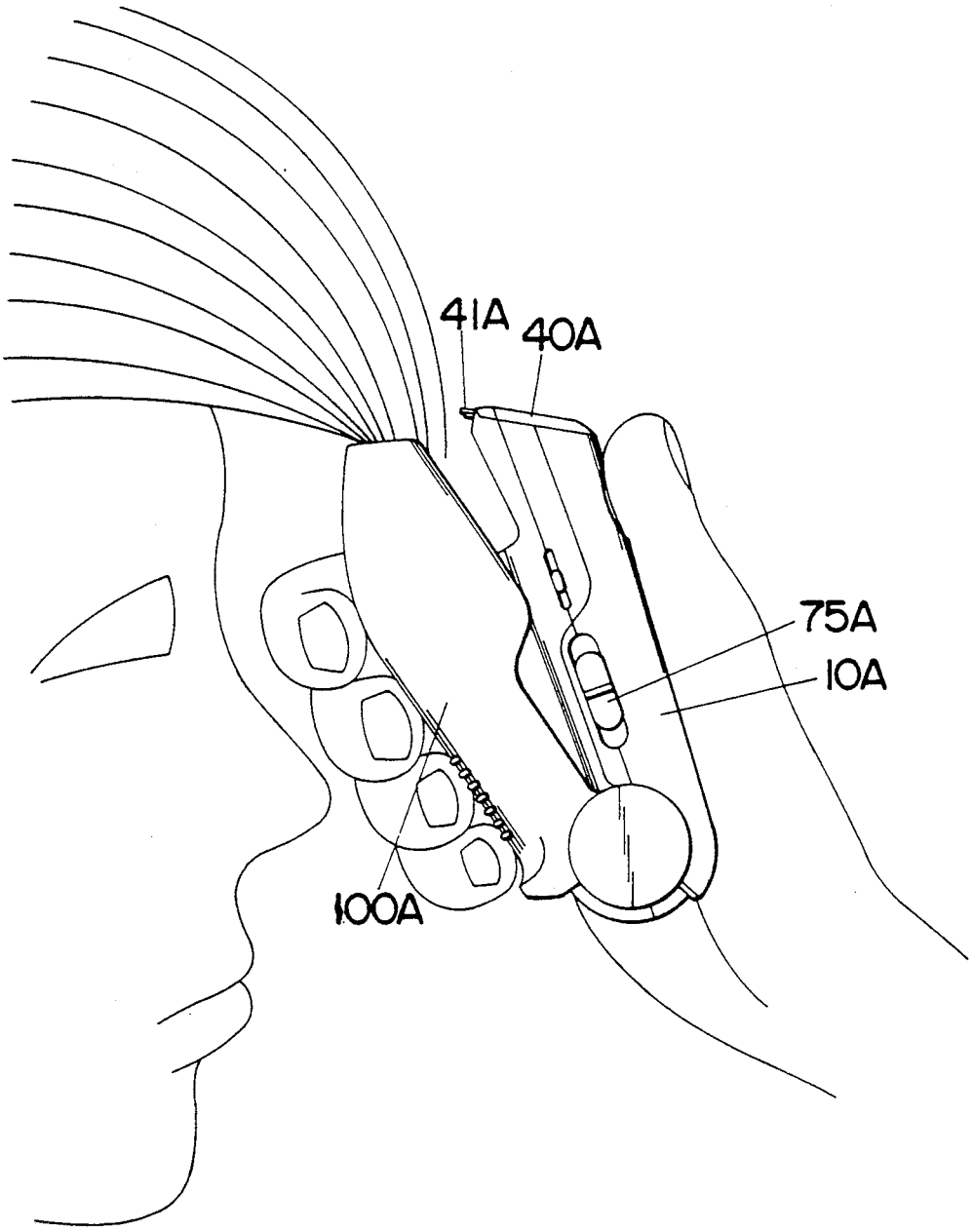
FIGS. 30A to 30B are respectively illustrations in different views of the hair clipper in its open condition.
Figure 30B:
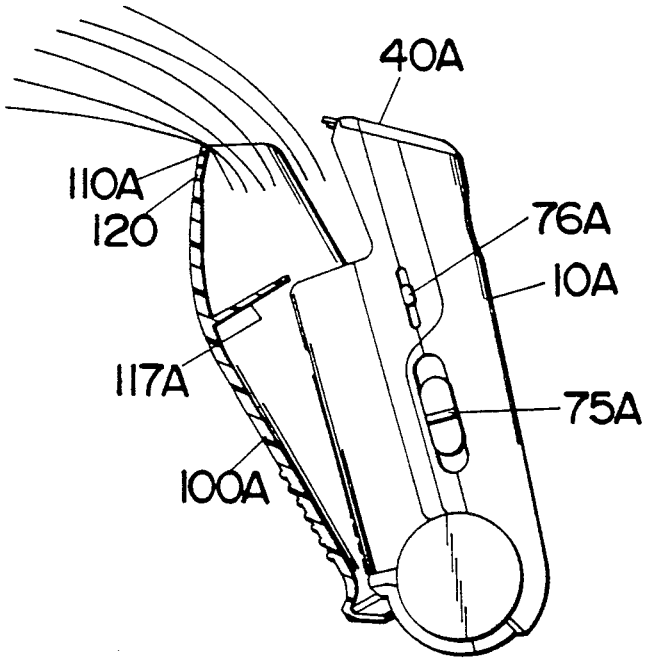
Figure 31A:
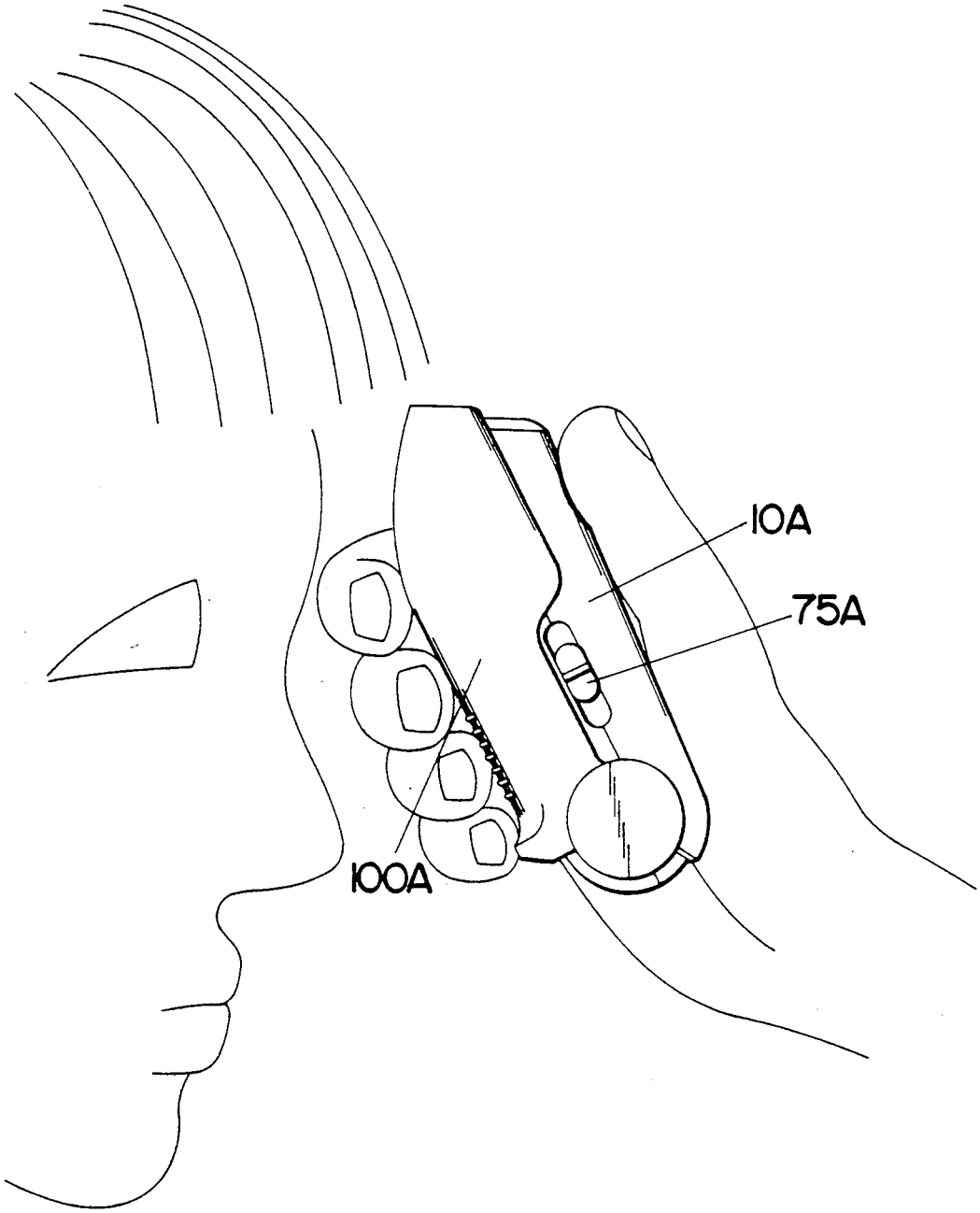
FIGS. 31A to 31B are respectively illustrations in different views of the hair clipper in its closed condition.
Figure 31B:
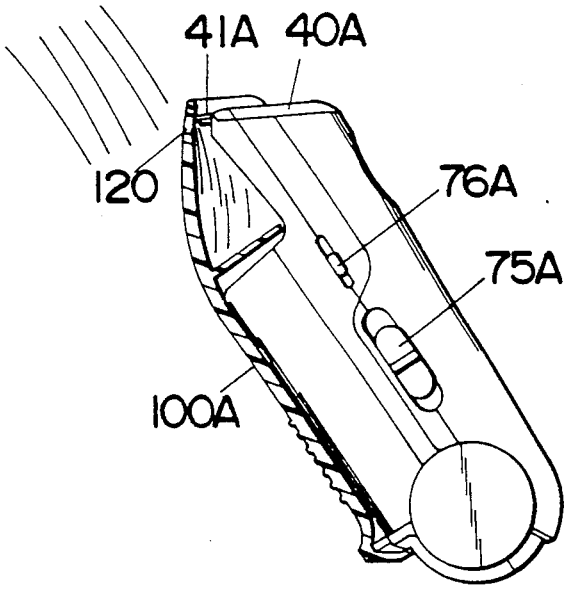
Figure 32:
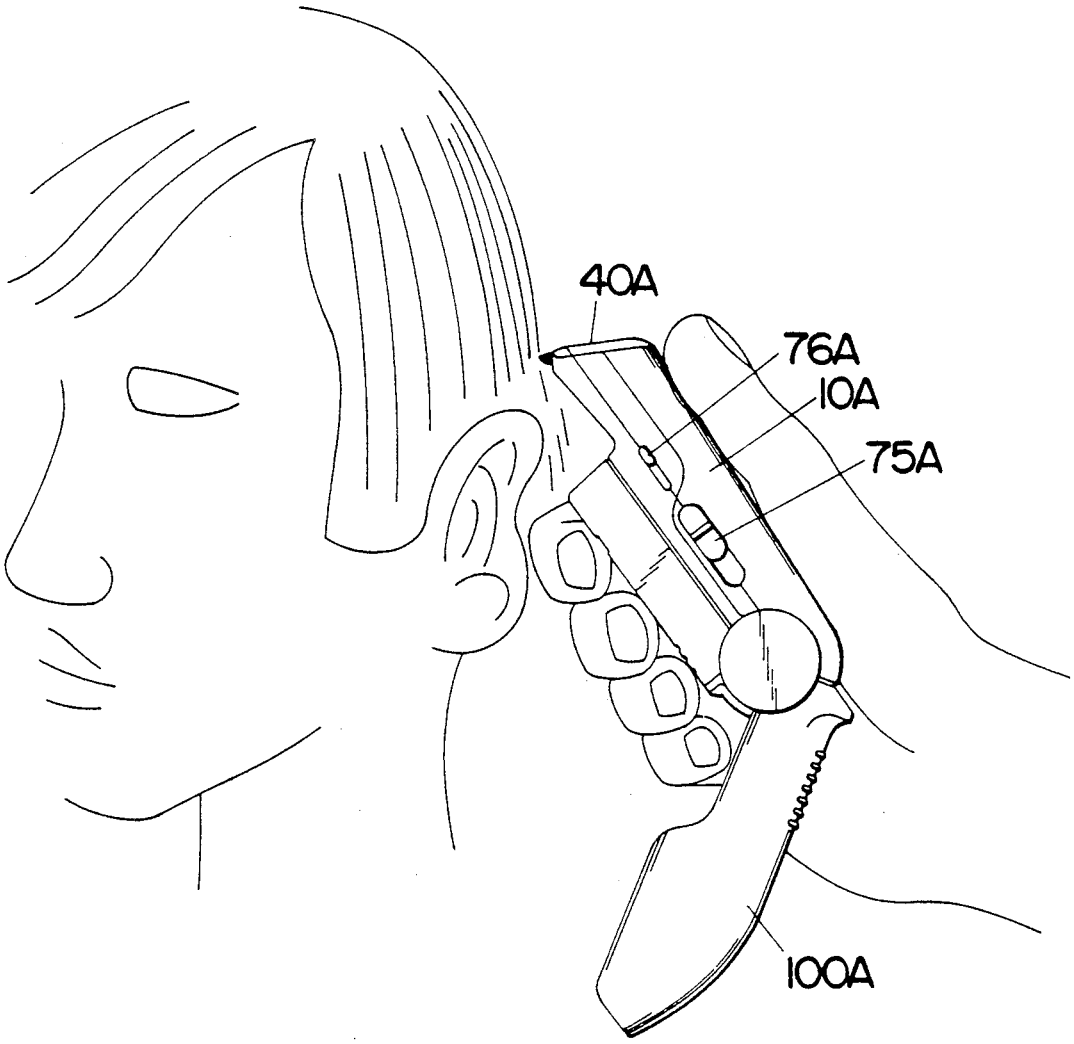
FIG. 32 is a view explaining the trimming operation of the hair clipper in its extended position.
Figure 33:
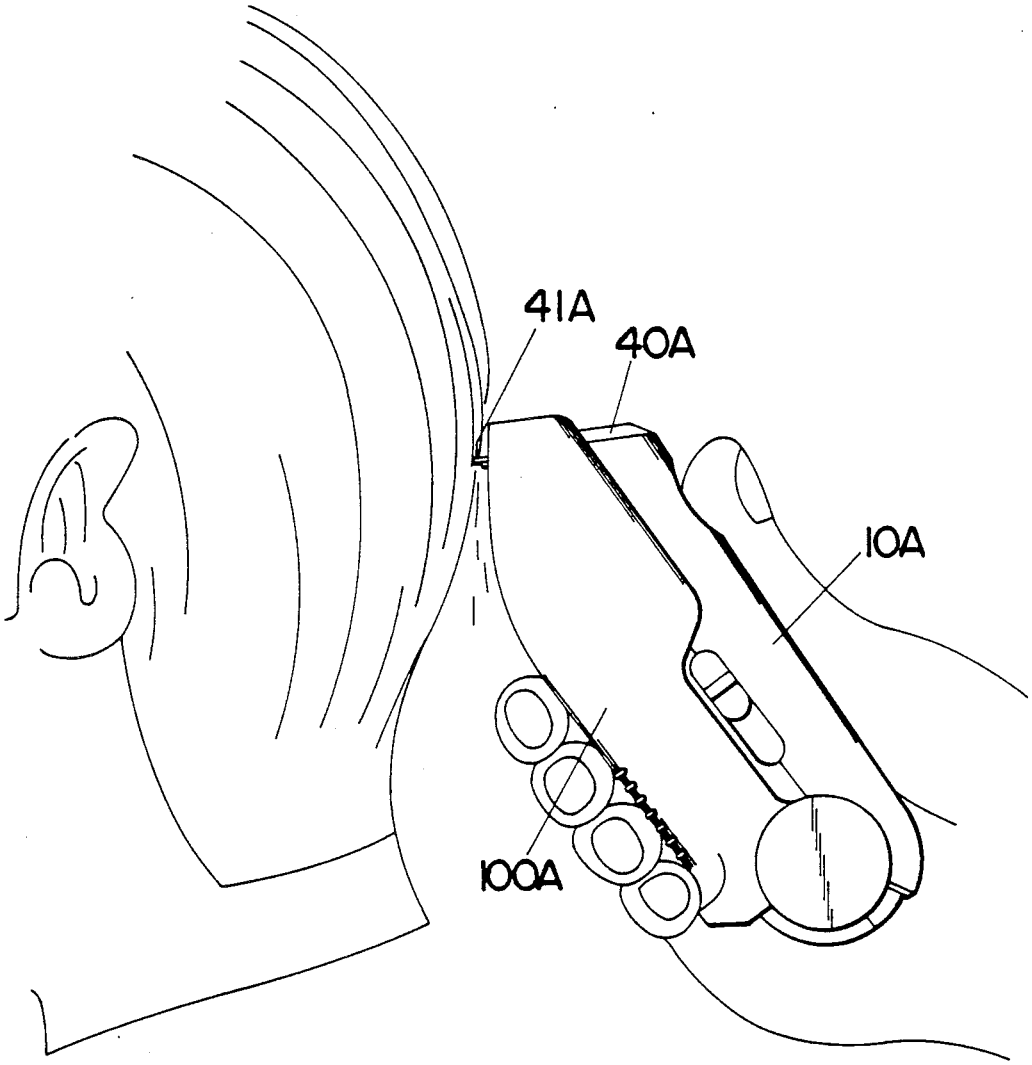
FIG. 33 is a view explaining another trimming operation for finishing cut with the cutting edge extending through the slot of the base cover.
Figure 34:
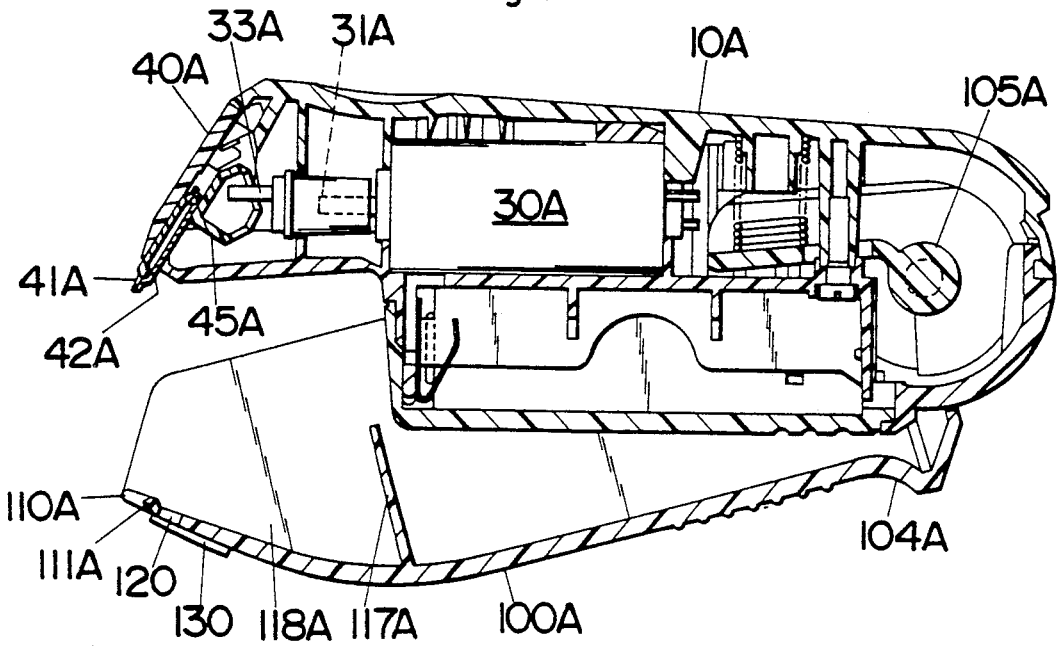
FIGS. 34 and 35 are sectional views of a hair clipper, respectively in its open and closed positions, in accordance with a first modification of the second embodiment.
Figure 35:
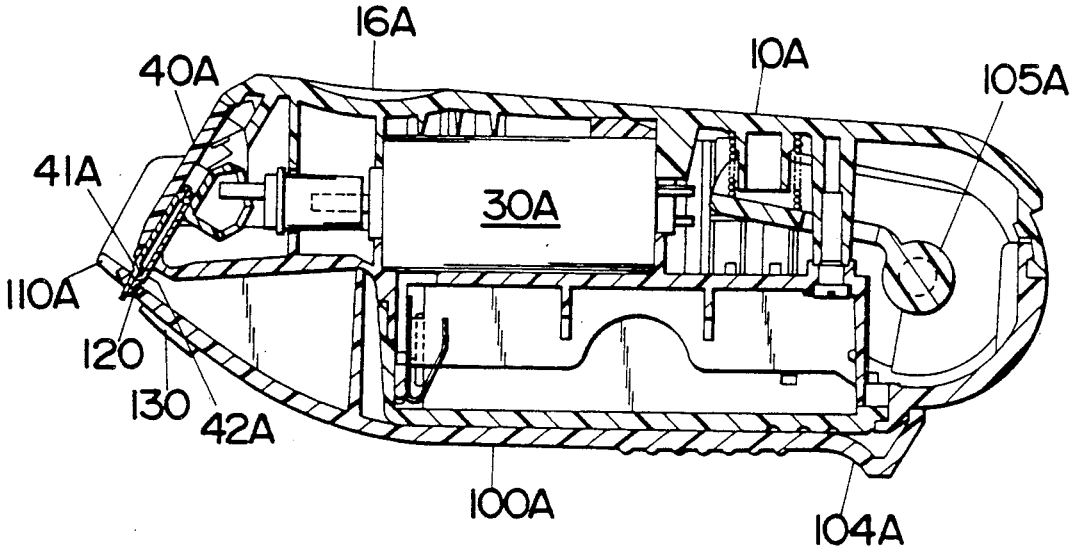

Referring to FIGS. 25 and 26, there is shown a hair clipper in accordance with a second embodiment of the present invention which is similar in structure to the above first embodiment. Therefore, like parts are designated by like numerals with a suffix letter of "A". The clipper of this embodiment contemplates to selectively limit the amount of the hairs to be cut by providing a slot 120 in a base cover 100A receiving a cutting edge of the clipper, instead of providing the hair thinning plate 80 as in the first embodiment. The slot 120 is formed immediately rearwardly of a comb-teeth 110A such that, when the base cover 100A is tightly closed on a housing 10A, or moved to an ex-closed position, the cutting edge extends through the slot 120 to expose only the tip portion thereof. That is, as shown in FIG. 29, in the ex-closed position, the cutting edge projects outwardly of the base cover 100A by an extent of l which defines an effective cutting depth for reduced hair shearing efficiency, particularly useful for fine trimming performed in a manner shown in FIG. 33. In this sense, the clipper of this embodiment can select to facilitate the fine trimming rather than the hair thinning. The base cover 100A can be of course manipulated into a normal closed position of directing the cutting edge close to the inner surface of the base cover 100A, so that the clipper of this embodiment can also effect the like hair shearing between the comb-teeth 110 and the cutting edge by repeating to open and close the base cover 100A, as shown in FIGS. 30A, 30B, 31A, and 31B. Unlike the first embodiment, the clipper of the present embodiment is powered by a dry battery (not shown) received in the lower portion of the housing 10A. Although there are still other minor structural differences in the clipper of the present embodiment from that of the first embodiment, these differences are not deemed to be material to the present invention and therefore the details thereof are not discussed herein. The structure of the clipper except for the provision of the slot 120 are fully explained in our previous application Ser. No. 446,124 filed on Dec. 5, 1989 & [P 39 41 660.7 filed on Dec. 13, 1989] & [89 27 820.4 filed on Dec. 8, 1989]. In brief, the clipper comprises the elongated housing 10A and an elongated base cover 100A hinged at its rear end to the housing 10A so that it is movable between an open position of FIG. 25 and a closed position of FIG. 26. The housing 10A is provided at its front end wit a cutter head 40A carrying a stationary blade 41A and a movable blade 42A which define the cutting edge. The movable blade 42A is driven by a motor 30A accommodated in the housing 10A. The motor 30A is energized and deenergized by means of a switch handle 75A which is also a three-position selector movable between an OFF-position, a conditional ON-position, and a constant ON-position in the like manner as in the first embodiment. The base cover 100A is hinged at 105A to be allowed to move further into an extended position of FIG. 32 for trimming the hairs at the cutting edge, and can be also detached from the housing 10A.

First Modification of the Second Embodiment

Figure 36:
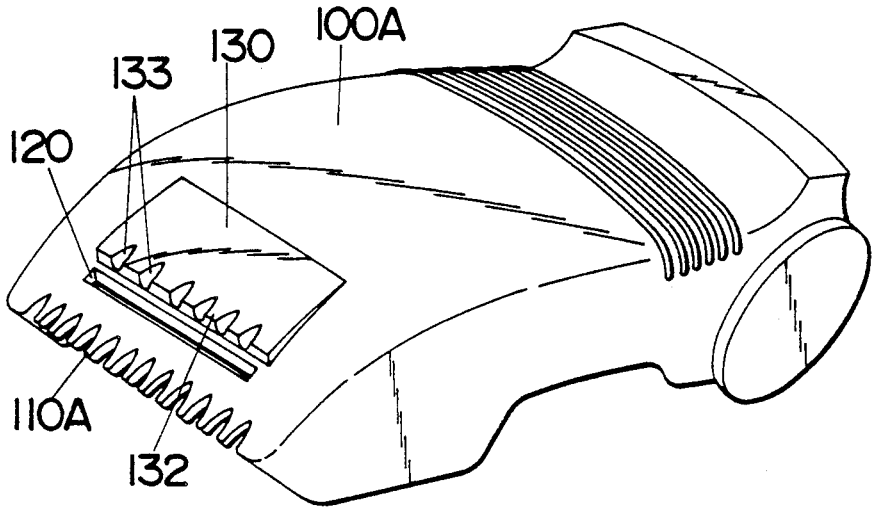
FIG. 36 is a perspective view of a base cover with a shutter utilized in the above modification.
Figure 37:
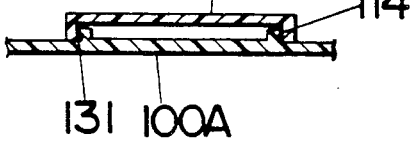
FIG. 37 is a partial sectional view illustrating a sliding connection of the shutter to the base cover of FIG. 36.
Figure 38:
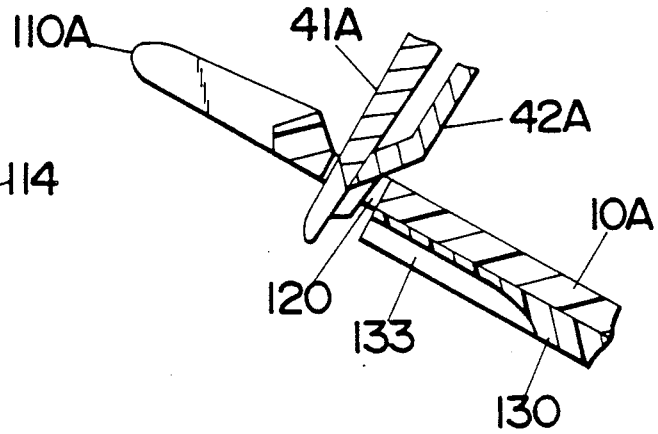
FIG. 38 is a partial view illustrating a relation between the cutting edge and the shutter in its advanced position towards the cutting edge.
Figure 39:
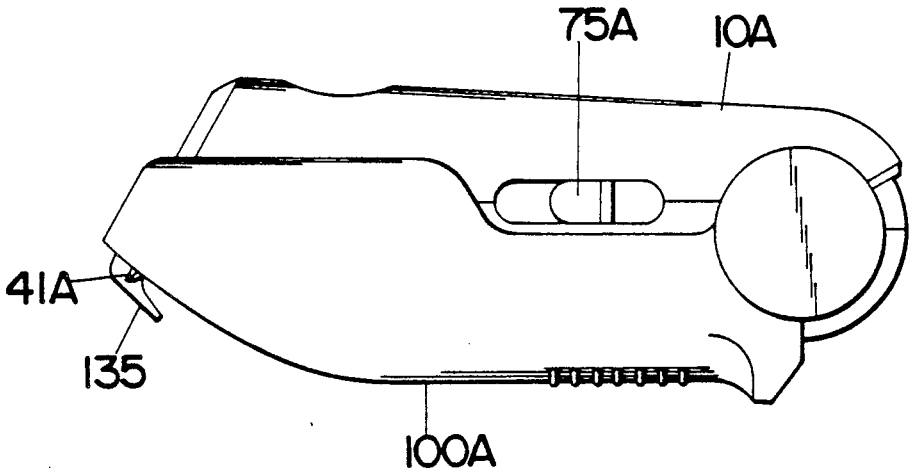
FIG. 39 is a side view of a hair clipper in accordance with a second modification of the second embodiment.
Figure 40:
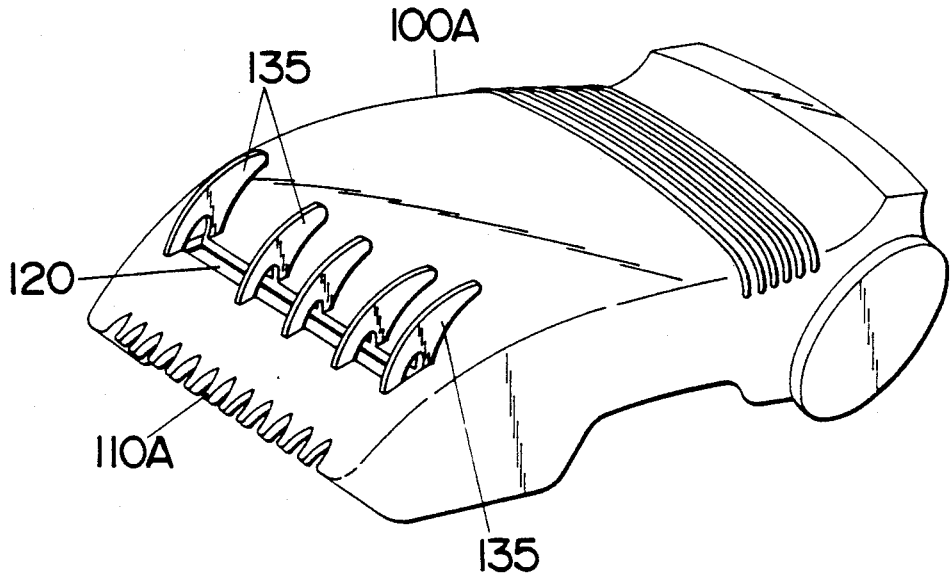
FIG. 40 is a perspective view of a base cover with a number of comb fins utilized in the above modification of FIG. 39.
Figure 41:
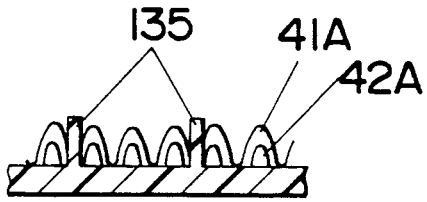
FIG. 41 is a partial sectional view illustrating the comb fins on the base cover in relation to the cutting edge extending outwardly through the base cover.

As shown in FIGS. 34 to 38, a modified clipper includes a shutter 130 slidable on the exterior of the base cover 100A to open and close the slot 120. The shutter 130 has on its lateral edge with hooks 131 which engage with corresponding guide rails 114 on the outer bottom of the base cover 100A for slidable connection therebetween. Formed in the forward edge of the shutter 130 is a row of teeth 132 defined between spaced ditches 133 in the front lower surface of the shutter 130, as shown in FIG. 36. The shutter 130 can be clicked into an intermediate position between two extreme positions of opening and closing the slot 120. At the intermediate position, the forward edge of the shutter 130 is positioned immediately behind the cutting edge extending outwardly of the base cover 100A, as shown in FIG. 38, so that the cutting edge is closed at portions corresponding to each of the teeth 132 and is open, or available for shearing only at limited portions corresponding to each of the ditches 133, thereby enabling a further limited hair shearing at the cutting edge in cooperation with the forward edge of the shutter 130. When the slot 120 is closed by the shutter 130, the cutting edge is prevented from projecting outwardly of the base cover 100A to facilitate the normal hear shearing between the comb-teeth 110 and the cutting edge.

Second Modification of the Second Embodiment

Figure 42:
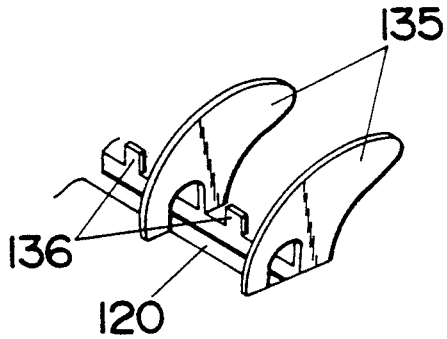
FIG. 42 is a partial perspective view illustrating a further modified configuration of the base cover.

Referring to FIGS. 39 to 42, a second modification provides a hair clipper provided with a row of comb fins 135 straddling over the slot 120 at spaced portions along the length thereof for smoothing the hairs towards and past the cutting edge projecting through the slot 120. In the like manner as the teeth 132 of the shutter 130 in the first modification, the comb fins 135 disable corresponding portions of the cutting edge for hair shearing to limit the amount of the hairs being cut, i.e., to effect the hair thinning. As shown in FIG. 42, additional projections 136 may be provided along the edge of the slot 120 between the comb fins 135 to further limit the hairs to be cut.

Third Modification of the Second Embodiment

Figure 43:
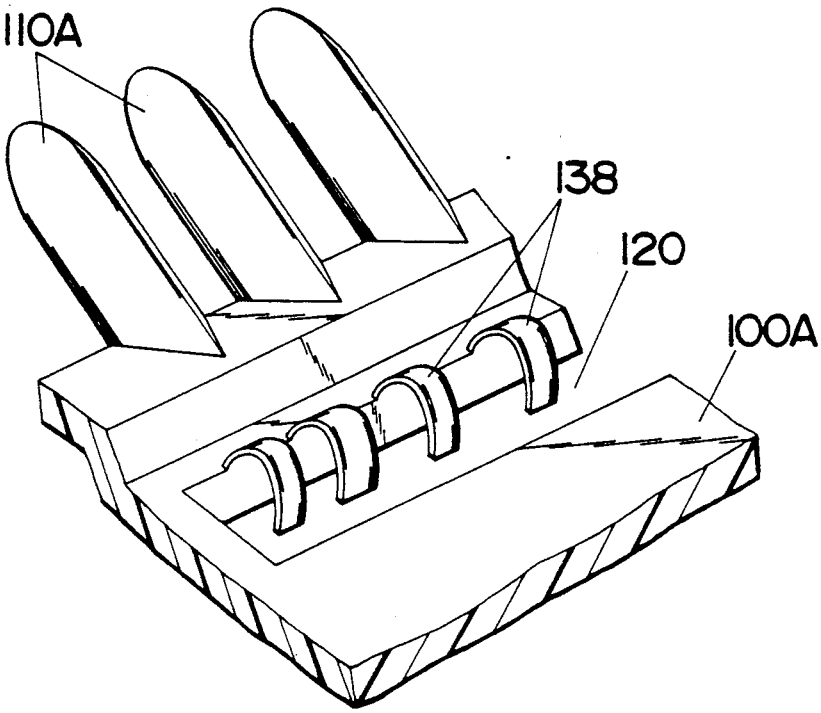
FIG. 43 is a partial perspective view of a base cover with a row of spring legs in accordance with a third modification of the second embodiment.
Figure 44A:
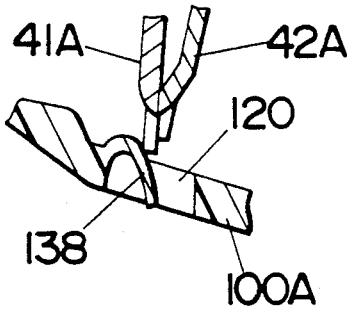
FIGS. 44A and 44B are views illustrating the operation of the spring legs in cooperation with the cutting edge.
Figure 44B:
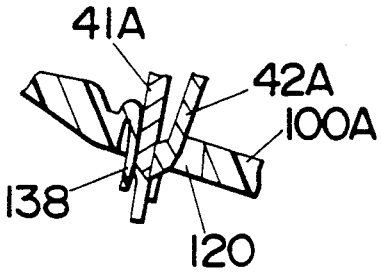
Figure 45:
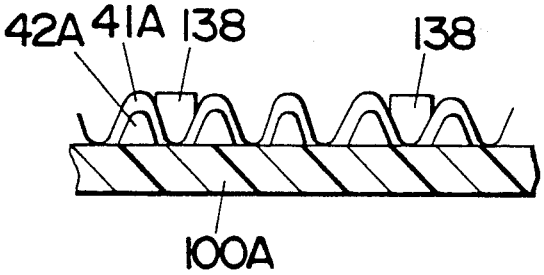
FIG. 45 is a partial sectional view taken in parallel with a slot in the base cover and illustrating a relation between the cutting edge and the spring legs.

FIGS. 43 to 45 illustrate a third modification which is characterized to have a row of generally U-shaped spring legs 138 arranged along the length of the slot 120. Each of the spring legs 138 extends integrally from the edge of the slot 120 and is bent into the slot 120 for pressed contact with the cutting edge entering the slot 120, as shown in FIGS. 44A and 44B. The spring legs 138 have enough resiliency which gives a resistive force to the cutting edge entering the slot 120 such that cutting edge can be easily maintained at the normal closed position of FIG. 44A and can be moved to the ex-closed position of FIG. 44B with a correspondingly force applied to overcome the resistive force, whereby the user can be readily confirmed of the intended operation. When the cutting edge is forced to project through the slot 120 for the limited hair shearing, the spring legs 138 act to bias the cutting edge away from the slot 120, which, in turn, biases the base cover 100A towards the open position, facilitating to move the cutting edge back from the slot 120. At this condition, the spring legs 138 serve to close or disable corresponding portions of the cutting edge, as shown in FIG. 45, to further limit the amount of the hairs to be cut at the cutting edge.

Figure 46:
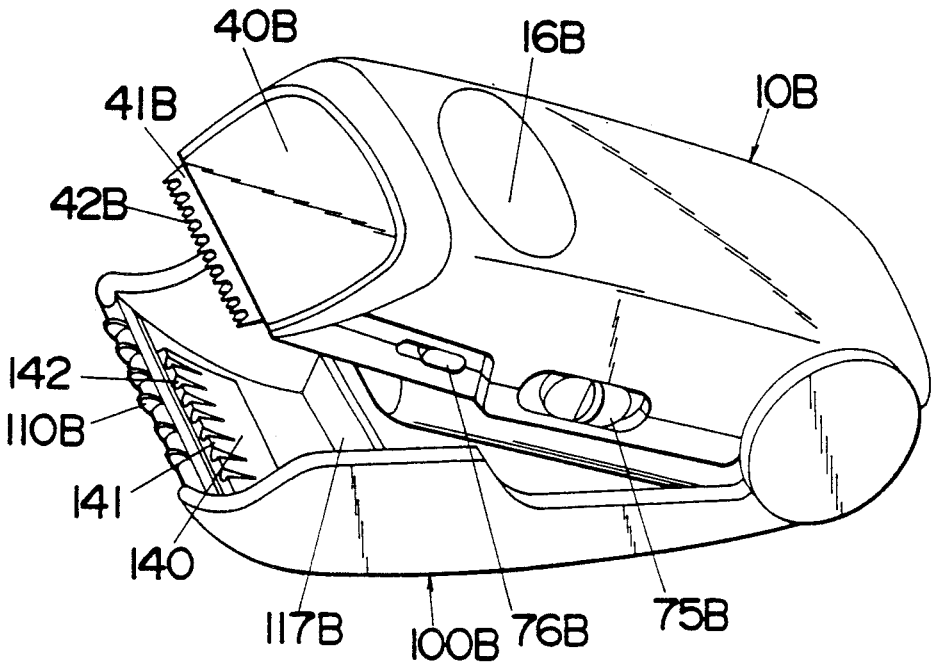
FIG. 46 is a perspective view of a hair clipper in accordance with a third embodiment.
Figure 47:
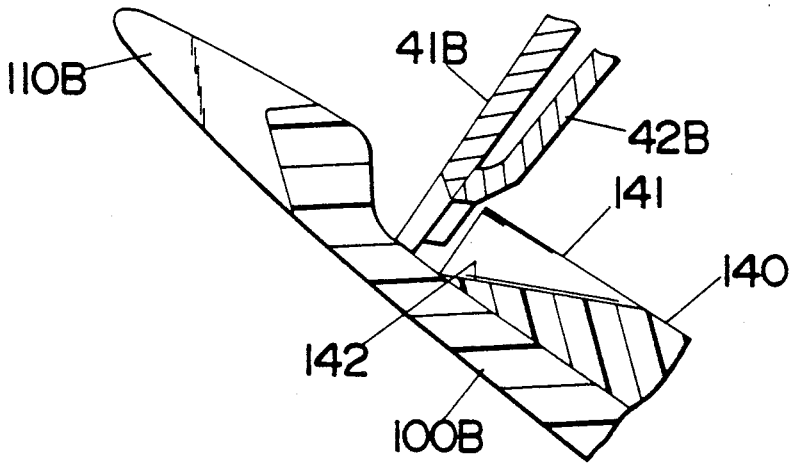
FIG. 47 is a partial view illustrating the operation of the hair clipper of FIG. 46.

Third Embodiment <FIGS. 46 and 47>

A hair clipper in accordance with a third embodiment of the present invention is identical to the second embodiment except that a hair thinning plate 140 is provided in place of providing the slot 120. Like parts are designated by like numerals with a suffix letter of "B". The hair thinning plate 140 is mounted on the inner bottom of the base cover 100C to be slidable between a forward position and a rearward position, and is provided at its front edge with a row of teeth 141 defined between ditches 142 cut into the front upper end of the plate 140 and arranged along the front edge thereof. In the rearward position, the teeth 141 are spaced rearwardly from the cutting edge by an enough distance to permit the hair shearing at the cutting edge independently of the teeth 141. When the plate 140 is advanced to the forward position, the teeth 141 come immediately behind the cutting edge to thereby permit the hairs to extends only through the ditches 142 past the cutting edge, and therefore disable the cutting edge at portions corresponding to the teeth 141, limiting the amount of the hairs to be cut through the cutting edge, i.e., assuring the hair thinning at the cutting edge in cooperation with the teeth 141.

Figure 48:
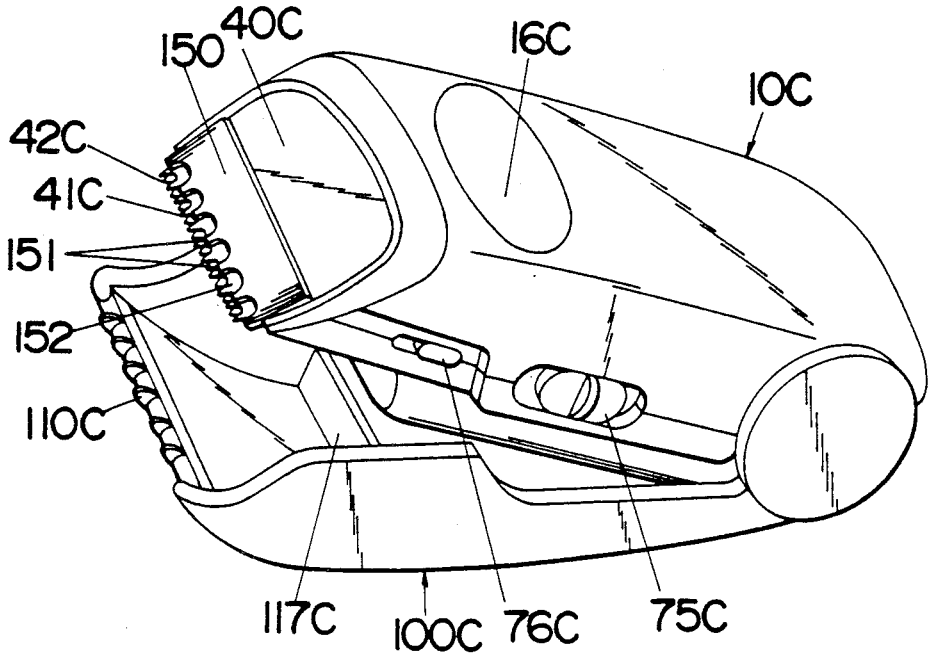
FIGS. 48 and 49 are respectively perspective views of a hair clipper in accordance with a fourth embodiment of the present invention.
Figure 49:
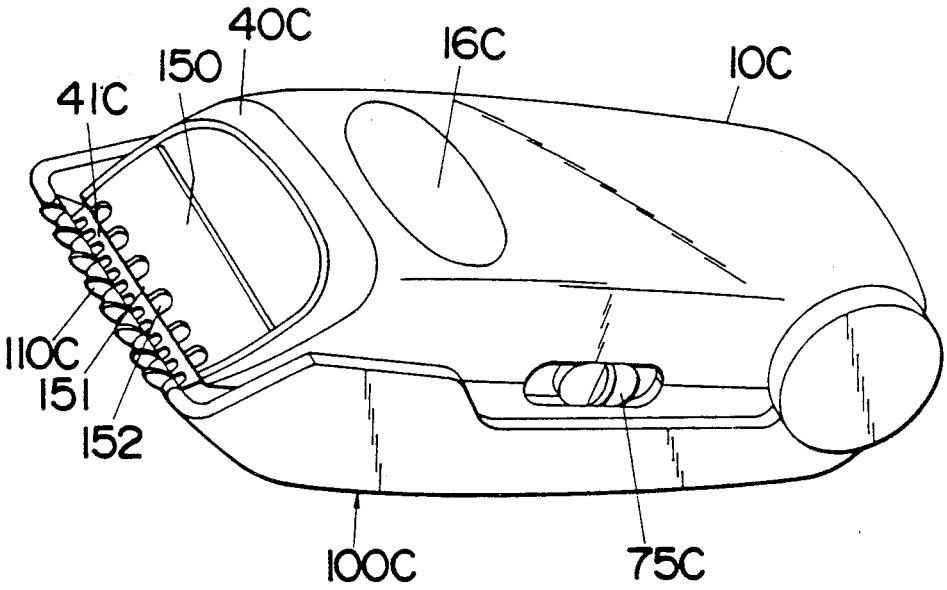
Figure 50:
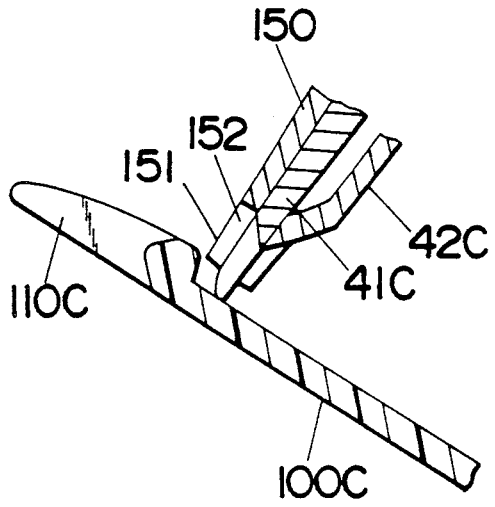
FIG. 50 is an enlarged view illustrating the operation of the hair clipper of FIG. 49.

Fourth Embodiment <FIGS. 48 to 50>

A hair clipper in accordance with a fourth embodiment is identical to the third embodiment except that a hair thinning plate 150 is mounted on a cutter head 40C rather than on the base cover. In the drawings, like parts are designated by like numerals with a suffix letter of "C". The hair thinning plate 150 has a row of teeth 151 defined by spaced slits 152 in the front edge of the plate 150 and arranged along the length of the edge. The plate 150 is movable along an inclined upper surface of the cutter head 40C and is clicked into an advanced position of FIG. 48 where the teeth 151 overlaps the cutting edge and into a retracted position of FIG. 49 where the teeth 151 is away from the cutting edge. In the advanced position, the teeth 151 of the plate 150 close corresponding portions of the cutting edge to expose only the remaining portions in communication with the slits 152 for allowing the hair shearing only at these portions, thereby enabling the hair thinning in cooperation with the hair thinning plate 150.

Figure 51A:
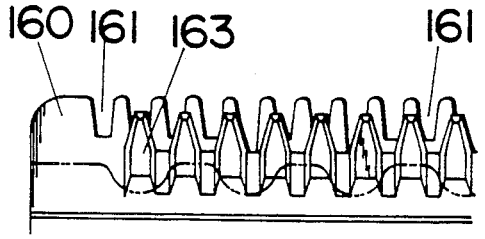
FIGS. 51A and 51B are partial views respectively illustrating the cutting edge of a hair clipper in accordance with a fifth embodiment of the present invention.

Fifth Embodiment <FIGS. 51 to 52>

Figure 51B:
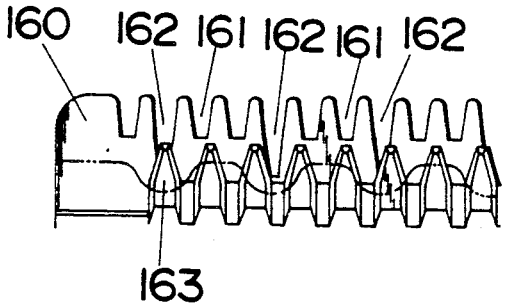
Figure 52A:
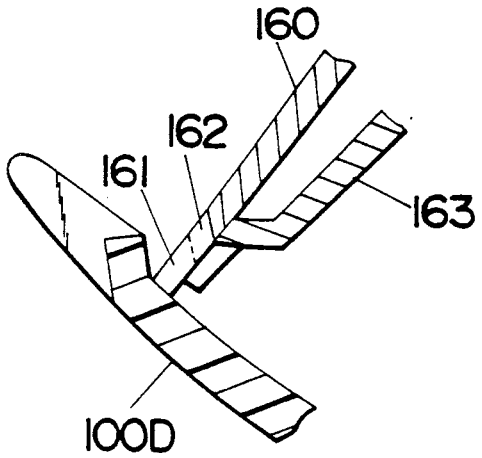
FIGS. 52A and 52B are partial views respectively of the cutting edge in relation to a base cover of the hair clipper in the closed position.
Figure 52B:
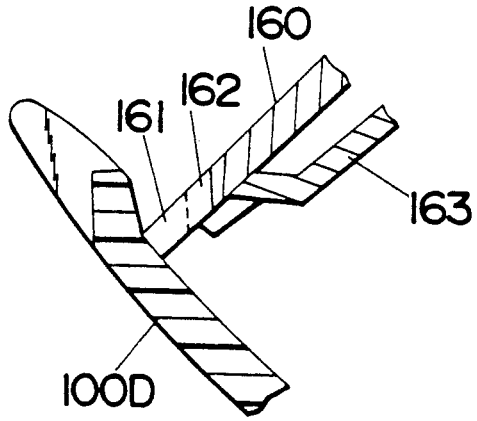

A hair clipper in accordance with a fifth embodiment of the present invention is identical to the third embodiment but has a specific arrangement for a cutter head. In this embodiment, the cutter head comprises a stationary blade 160 and a movable blade 163 which is driven to reciprocate relative to the stationary blade 160 and which can be further shifted in the edgewise direction relative to the stationary blade 160 As seen in FIG. 51B, the stationary blade 160 is formed in its forward edge with a row of teeth which is composed of first teeth 161 of smaller depth and second teeth 162 of larger depth, while the movable blade 163 is formed along its forward edge with a row of teeth of equal depth. The second tooth 162 of larger depth appears in every third occurrence in the row in such a way that the first teeth 161 of smaller depth are divided into several groups which are alternated by the second teeth 162. In operation, when the movable blade 163 is shifted to the forwardmost position of FIGS. 51A and 52A, it is cooperative with the stationary blade 160 to give a hair cutting mode in which substantially the entire depth of the first teeth 161 and the corresponding depth of the second teeth 162 of the stationary blade 160 come into shearing engagement with the teeth of the movable blade 163 to shear the hairs entrapped between the cutting edge and a base cover 100D in the closed position. When, On the other hand, the movable blade 163 is shifted to a rearmost position of FIGS. 51B and 52B, it gives a hair thinning mode in which only the second teeth 162 of the stationary blade 160 have its bottom portions into shearing engagement with the teeth of the movable blade 163 to define a reduced shearing zone effective for a hair thinning in cooperation with the base cover 100D. The selection between the above different hair styling modes can be made by simply manipulating a suitable handle operatively connected to the movable blade 163. Although the movable blade 163 is shifted in the direction perpendicular to the reciprocation in the embodiment, it is equally possible to make the stationary blade 161 movable in that direction relative to the movable blade 163 for changing the hair styling modes.

What is claimed is:

1. A hair clipper comprising:

a housing having front and rear ends;

a cutter head on the front end of said housing and comprising a stationary blade with a row of teeth and a movable blade with a row of teeth, means driving said movable blade to reciprocate relative to said stationary blade in hair shearing engagement between the respective teeth of said stationary and movable blades, said teeth cooperating to define a cutting edge; and a base cover formed with a hair entrapping edge, said base cover being connected to said housing such that said hair entrapping edge extends substantially parallel with said cutting edge and is movable relative thereto between an open position where the hair entrapping edge is spaced from said cutting edge and a closed position where said hair entrapping edge is held in close to said cutting edge, said hair entrapping edge in said open position allowing hairs to extend past said cutting edge and said hair entrapping edge in said closed position for shearing the hairs at said cutting edge;

said hair clipper including adjust means for adjusting the amount of the hairs to be cut at said cutting edge, said adjust means being adjustable for selection between a first cutting condition in which substantially the entire teeth of said stationary and movable blades are in hair shearing engagement and a second cutting condition in which only particular regions of said stationary and movable blades are in hair shearing engagement.

2. A hair clipper as set forth in claim 1, wherein said adjust means comprises a hair thinning plate with a comb-like edge at its front end, said hair thinning plate being slidable along the length of said housing to be movable between said first cutting condition where said comb-like edge is spaced away from said cutting edge to permit the entire teeth of said stationary and movable blades to be in hair shearing engagement and said second cutting condition where said comb-like edge extends over said cutting edge to permit only the particular regions of the teeth of said stationary and movable blades to be in hair shearing engagement.

3. A hair clipper as set forth in claim 2, wherein said hair thinning plate has a slide handle accessible by a finger of the user holding said housing, said slide handle provided on said housing in front of a switch handle for making and breaking the hair shearing movement between said stationary and movable blade.

4. A hair clipper as set forth in claim 1, wherein said adjust means comprises a hair thinning plate with a comb-like edge at its front end, said hair thinning plate being slidable on said cutting head along the edgewise direction of said cutting edge to be movable between said first cutting condition where said comb-like edge is spaced away from said cutting edge to permit the entire teeth of said stationary and movable blades to be in hair shearing engagement and said second cutting condition where said comb-like edge extends over said cutting edge to permit only the particular regions of the teeth of said stationary and movable blades to be in hair shearing engagement.

5. A hair clipper as set forth in claim 1, wherein said adjust means comprises a hair thinning plate with a row of comb-like teeth at its front edge, said hair thinning plate being slidable on the bottom of said base cover along the lengthwise direction thereof to be movable between said first cutting condition where said row of comb-like teeth is spaced rearwardly from said cutting edge to enable the hair shearing at substantially the entire region of said cutting edge and said second cutting condition where said row of comb-like teeth comes close the rear of said cutting edge to mask particular regions of said cutting edge, thereby disabling the hair shearing at that particular regions of said cutting edge in closely adjacent relation to said comb-like teeth.

6. A hair clipper as set forth in claim 1, wherein said movable blade is mounted to move relative to said stationary blade in a direction of varying the distance between the forward edges of said movable and stationary blades, said stationary blade being formed in its forward edge with a row of teeth composed of first teeth of small depth and second teeth of greater depth, said first teeth being divided into several groups which are alternated by said second teeth;

said adjust means causing said movable blade to relatively shift selectively into said first hair cutting condition in which substantially the entire depth of each of the first teeth and the corresponding depth of the second teeth of the stationary blade are in hair shearing engagement with those of the movable blade and into said second hair cutting condition in which only the bottom portion of each of the second teeth of the stationary blade is in hair shearing engagement with those of the movable blade.

7. A hair clipper as set forth in claim 1, wherein said hair entrapping edge is in the form of a comb.

8. A hair clipper as set forth in claim 1, wherein said base cover is hinged at its rear end to the rear end of said housing, and said base cover is biased towards to said open position from said closed position.

9. A hair clipper as set forth in claim 8, wherein said housing accommodates a motor for driving said movable blade to move relative to said stationary blade and includes a switch for energizing and deenergizing said motor, said switch being interlocked with said base cover such that it energizes said motor when said base cover is in the closed position and deenergizes it when said base cover is in said open position.

10. A hair clipper as set forth in claim 9, wherein said switch is actuated by a switch handle on the exterior of said housing and has a first mode in which it energizes and deenergizes said motor in synchronism with the movement of said cover between said open and closed positions and a second mode in which it energize and deenergizes said motor independently of said open and closed positions.

11. A hair clipper as set forth in claim 1, wherein said base cover is detachably connected to said housing and is held thereto by means of a retainer spring, said retainer spring allowing said base cover to move between said open and closed positions and allowing said base cover to be moved further past said open position.

12. A hair clipper as set forth in claim 1, wherein said adjust means comprises a slot which is formed in said base cover immediately rearwardly of said hair entrapping edge and extends in parallel therewith, said base cover being allowed to move past said closed position into said second hair cutting position where said cutting edge extends through said slot to expose only the forwardmost portion of said cutting edge outwardly of said base cover while concealing the remaining portion of the cutting edge within said slot, thereby limiting the amount of the hairs to be cut at said second hair cutting position.

13. A hair clipper as set forth in claim 12, further including a shutter movably supported on said base cover to close and open said slot.

14. A hair clipper as set forth in claim 13, wherein said shutter has a row of grooves at its forward edge and is allowed to move in a position where said row of grooves comes immediately behind said forwardmost portion of the cutting edge extending outwardly through said slot such that only the portions of the cutting edge in registration with said grooves are permitted to effect the hair shearing.

15. A hair clipper as set forth in claim 12, further including a row of comb projections straddling over said slots in order to mask corresponding particular portions of said cutting edge extending through, thereby disabling the hair shearing at said particular portions.

16. A hair clipper as set forth in claim 12, wherein said base cover includes a plurality of spring legs spaced along the length of said slot and extending thereinto for spring contact with corresponding portions of said cutting edge when said cutting edge extends into said slot, whereby disabling the hair shearing at the portions of the cutting edge in contact with said spring legs, said spring legs being flexed when contacted with said cutting edge to thereby bias said cutting edge away from said slot.

* * * * *